US008918014B2

(12) United States Patent
Yoshimura et al.

(10) Patent No.: US 8,918,014 B2
(45) Date of Patent: Dec. 23, 2014

(54) ELECTROPHOTOGRAPHIC IMAGE FORMING APPARATUS

(75) Inventors: Akira Yoshimura, Suntou-gun (JP); Daisuke Takamura, Fujinomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 557 days.

(21) Appl. No.: 12/964,255

(22) Filed: Dec. 9, 2010

(65) Prior Publication Data

US 2011/0142489 A1 Jun. 16, 2011

(30) Foreign Application Priority Data

Dec. 11, 2009 (JP) ..... 2009-281858
Nov. 19, 2010 (JP) ..... 2010-258559

(51) Int. Cl.
*G03G 21/18* (2006.01)
*G03G 21/16* (2006.01)

(52) U.S. Cl.
CPC ..... *G03G 21/1821* (2013.01); *G03G 2221/169* (2013.01); *G03G 21/1666* (2013.01); *G03G 21/1633* (2013.01); *G03G 21/1835* (2013.01)
USPC ..... 399/113

(58) Field of Classification Search
USPC ..... 399/110, 111, 113, 114
See application file for complete search history.

(56) References Cited

U.S. PATENT DOCUMENTS 5,978,626 A * 11/1999 Nagamine et al. ..... 399/125
6,434,350 B2 8/2002 Kikuchi et al.
7,509,071 B2 3/2009 Yoshimura et al.
7,778,570 B2 8/2010 Numagami et al.
7,860,433 B2 12/2010 Toba et al.
7,869,740 B2 1/2011 Yoshimura et al.
2009/0003876 A1 1/2009 Maeshima et al.
2009/0317128 A1* 12/2009 Jang ..... 399/110
2010/0272469 A1 10/2010 Numagami et al.
2010/0303478 A1* 12/2010 Nakajima et al. ..... 399/13
2011/0064459 A1 3/2011 Toba et al.
2011/0110682 A1 5/2011 Yoshimura et al.

FOREIGN PATENT DOCUMENTS

JP 11-65400 3/1999
JP 2008-216762 9/2008

* cited by examiner

*Primary Examiner* — Walter L Lindsay, Jr.
*Assistant Examiner* — Barnabas Fekete
(74) *Attorney, Agent, or Firm* — Fitzpatrick, Cella, Harper & Scinto

(57) ABSTRACT

An electrophotographic image forming apparatus includes a main assembly and a cartridge including a process device actable on an electrophotographic photosensitive member. The process cartridge is detachably mountable relative to the main assembly, with the cartridge including a first unit and a second unit pivotably connected with the first unit. An opening is provided in the main assembly of the apparatus for permitting mounting and demounting of the cartridge. An openable member is provided in the main assembly of the apparatus for openably closing the opening. An exposure device is provided on the openable member for exposing the electrophotographic photosensitive member. A first positioning portion is provided in the main assembly. The exposure device is provided with a second positioning portion for positioning between the exposure device and the second unit of the cartridge by engagement with the cartridge by closing the openable member.

9 Claims, 16 Drawing Sheets

(a)

(b)

(a)

(b)

(a)

(b)

(a)

(b)

(a)

(b)

(a)

(b)

(a)

(b)

ELECTROPHOTOGRAPHIC IMAGE FORMING APPARATUS

FIELD OF THE INVENTION AND RELATED ART

The present invention relates to an electrophotographic image forming apparatus which forms an image on recording medium while one or more removably mountable process cartridges are in the main assembly of the apparatus.

In this specification, an "electrophotographic image forming apparatus" means an apparatus which forms an image on recording medium with the use of an electrophotographic image formation process. Its examples include an electrophotographic copying machine, an electrophotographic printer (laser beam printer, LED printer, etc.), a facsimile apparatus, a word processor etc. "Recording medium" means medium on which an image can be formed with the use of an electrophotographic image forming apparatus. It includes ordinary paper, OHP sheet, etc.

Further, a "cartridge" means a process cartridge or a development cartridge. That is, it means a cartridge which contributes to a process for forming an image on recording medium by being removably mounted in the main assembly of an electrophotographic image forming apparatus. More specifically, it means a process cartridge which is removably mountable in the main assembly of an electrophotographic image forming apparatus. It comprises: an electrophotographic photosensitive member; at least one processing means among a charging means, a developing means, a cleaning means; and a cartridge in which the electrophotographic photosensitive member and processing means are integrally placed. In other words, a process cartridge includes a cartridge in which an electrophotographic photosensitive member is integrally placed along with at least one among a charging means, a developing means, or a cleaning means so that they can be removably mountable in the main assembly of an image forming apparatus. Incidentally, a process cartridge which has an electrophotographic photosensitive member and a developing means is referred to as a process cartridge of the integral type. Further, a process cartridge which has an electrophotographic photosensitive member and one or more processing means other than a developing means is referred to as a process cartridge of the separation type.

A process cartridge is removably mountable in the main assembly of an image forming apparatus by a user himself or herself. Thus, a process cartridge makes it easier to maintain an image forming apparatus. Incidentally, processing means are means for processing an electrophotographic photosensitive member.

Further, a development cartridge has a development roller. It contains developer (toner) to be used by the development roller to develop an electrostatic latent image on an electrophotographic photosensitive member. It also is removably mountable in the main assembly of an electrophotographic image forming apparatus. In the case of an electrophotographic image forming apparatus which uses a development cartridge, its electrophotographic photosensitive member is a part of the main assembly of the image forming apparatus, or a part of a process cartridge of the so-called separation type (which does not have developing means). A development cartridge also can be removably mountable in the main assembly of an electrophotographic image forming apparatus by a user himself or herself. Thus, it also makes it easier to maintain an electrophotographic image forming apparatus.

That is, a "cartridge" includes both a process cartridge of the so-called integration type and a process cartridge of the so-called separation type. It also includes a process cartridge which is employed in combination with a process cartridge of the so-called separation type by an electrophotographic image forming apparatus. Further, it includes a development cartridge which is removably mountable in the main assembly of an image forming apparatus whose electrophotographic photosensitive member is an integral part of the main assembly, to process the electrophotographic photosensitive member.

In the field of an electrophotographic image forming apparatus, that is, an image forming apparatus which uses an electrophotographic image formation process, it has become common practice to employ a cartridge system, that is, a system which makes it possible to removably mount a cartridge in the main assembly of an electrophotographic image forming apparatus. As a cartridge of this type, a process cartridge, which integrally comprises an electrophotographic photosensitive drum (which hereafter will be referred to simply as photosensitive drum) and processing means for processing the photosensitive drum, has been known.

Further, image forming apparatuses of the so-called inline type have been known, which employ two or more process cartridges which are placed in line with each other in the main assembly of the apparatus. One of the image forming apparatuses of the so-called inline type is an electrophotographic image forming apparatus which employs four process cartridges for yellow, magenta, cyan, and black colors, one for one. It forms a full-color image by forming a monochromatic image on the photosensitive drum in each process cartridge by outputting a beam of laser light from its laser scanner unit, and layering the four monochromatic images which are different in color.

It has been known that some of the above-described image forming apparatuses are structured so that process cartridges are removably mountable in the main assembly of the image forming apparatus by opening a cover (door) with which the main assembly is provided. Japanese Laid-open Patent Application 2008-216762 discloses an image forming apparatus structured so that as the cover (door) of the image forming apparatus is opened for the mounting of process cartridges into the main assembly, or removal of the process cartridges from the main assembly, the laser scanner of the image forming apparatus is moved out of the way to allow the process cartridges to be mounted into the main assembly or removed from the main assembly, through the opening exposed by the opening of the cover, and also, that as the cover is closed, the laser scanner unit is moved back into its operational position.

SUMMARY OF THE INVENTION

However, in the case of the image forming apparatus disclosed in the abovementioned patent application, the process cartridges and laser scanner are positioned relative to the main assembly of the image forming apparatus, independently from each other. Therefore, it is necessary to provide the image forming apparatus with a space for preventing the process cartridges from interfering with the beam of laser light outputted from the laser scanner unit. Thus, the image forming apparatus is unsatisfactory from the standpoint of spatial efficiency with which its internal components are positioned in the main assembly. In other words, the employment of the above-described structural arrangement is likely to increase an image forming apparatus in size.

Thus, the primary object of the present invention is to provide such an innovative design for an image forming apparatus of the separation type that can reduce an image forming apparatus of the separation type in size by minimizing the image forming apparatus in the space necessary to prevent a process cartridge from interfering with the beam of laser light outputted from the laser scanner unit of the image forming apparatus, and improving thereby the image forming apparatus in terms of the spatial efficiency with which the internal components of the apparatus can be positioned in the main assembly of the apparatus.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 3(*c*) is a side view of the process cartridge in FIG. 3(*a*).

FIG. 8(*b*) is a side view of view of the combination of the intermediary transfer unit, process cartridges, laser scanner unit, and door of the image forming apparatus in the third preferred embodiment of the present invention, and is for describing the cartridge positioning mechanism of the apparatus.

FIG. 12(*b*) is a side view of view of the combination of the intermediary transfer unit, process cartridges, laser scanner unit, and door of the image forming apparatus in the fifth preferred embodiment of the present invention, and is for describing the cartridge positioning mechanism of the apparatus.

FIG. 14(*b*) is a sectional view of the image forming apparatus in FIG. 14(*a*) when the door is open and a couple of the process cartridges are being moved out of the main assembly.

FIG. 15(*b*) is a perspective view of the process cartridge in FIG. 15(*a*) when the development unit and photosensitive drum unit are not in engagement with each other.

DESCRIPTION OF THE PREFERRED EMBODIMENTS

Hereinafter, the preferred embodiments of the present invention are described with reference to the electrophotographic image forming apparatuses in accordance with the present invention. The measurements, materials, and shapes of the structural components of each of the electrophotographic image forming apparatuses in the following preferred embodiments of the present invention, and their positional relationship, are to be modified as necessary according to the structure of the image forming apparatus to which they belong, and conditions under which they are operated. In other words, the following preferred embodiments are not intended to limit the present invention in scope unless specifically noted.

Embodiment 1

Figure 1:
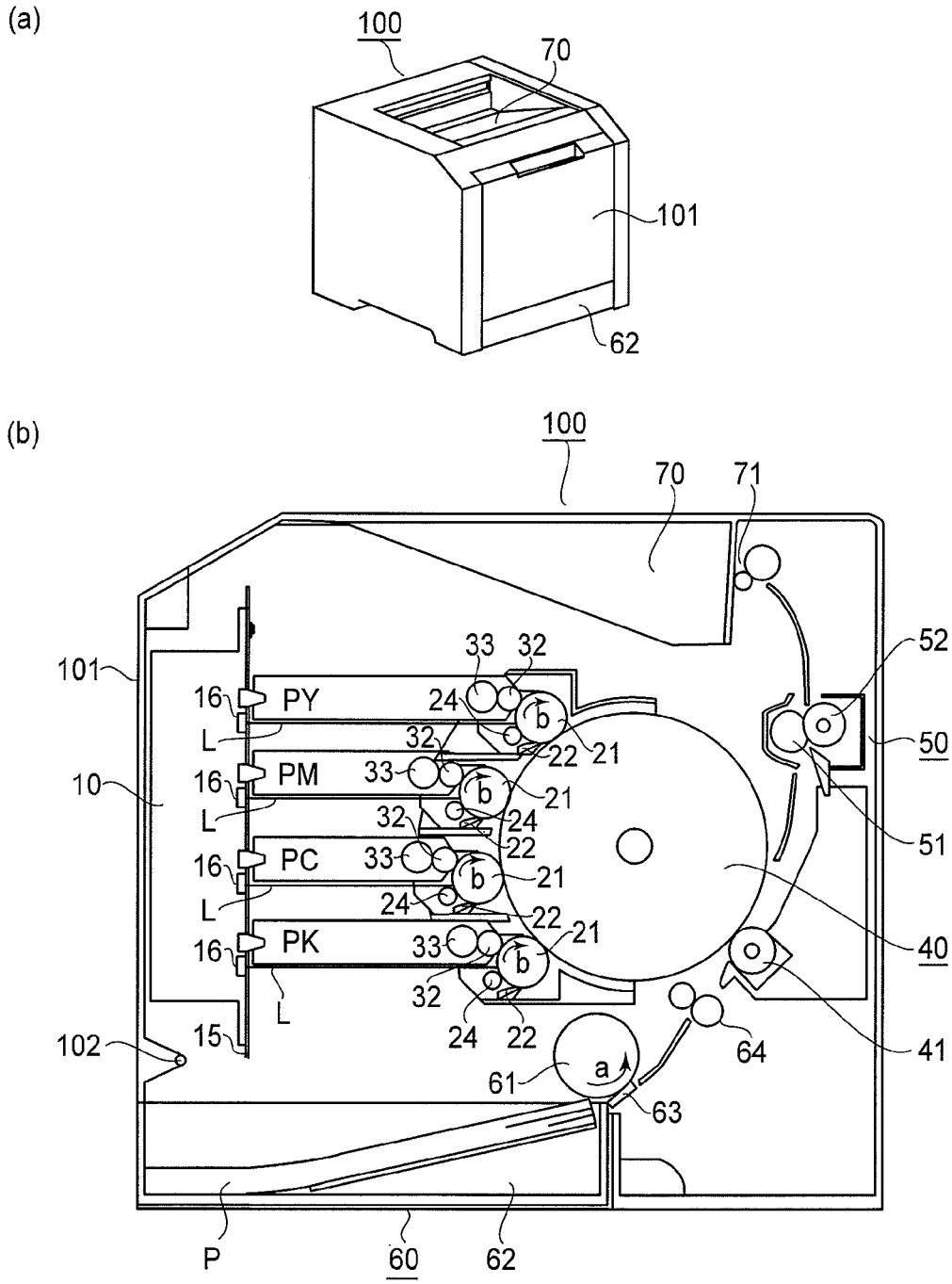
FIG. 1(*a*) is a perspective view of the electrophotographic image forming apparatus in the first preferred embodiment of the present invention, and FIG. 1(*b*) is a sectional view of the electrophotographic image forming apparatus in FIG. 1(*a*).
Figure 2A:
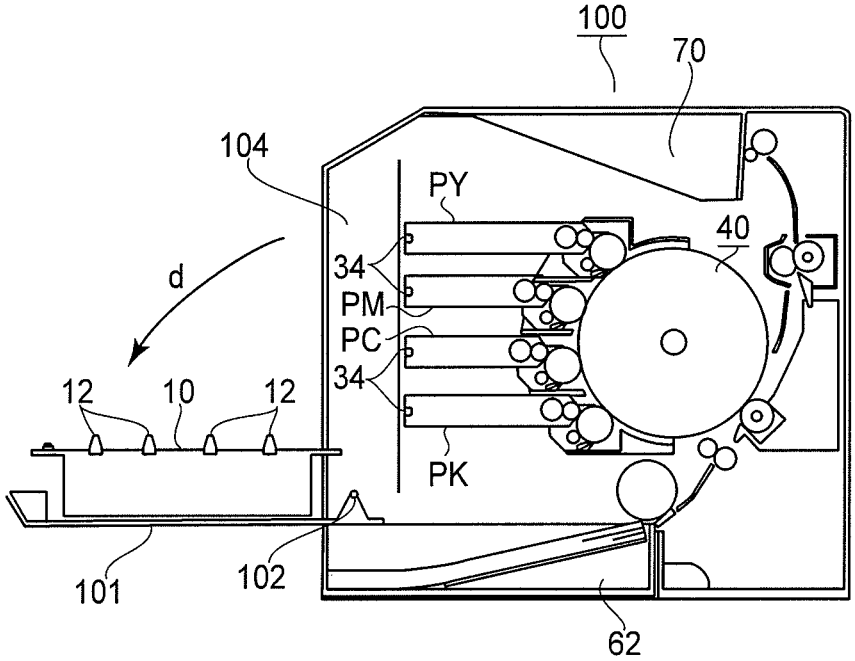
FIG. 2A is a sectional view of the electrophotographic image forming apparatus in the first preferred embodiment of the present invention when its cartridge placement door is open.
Figure 2B:
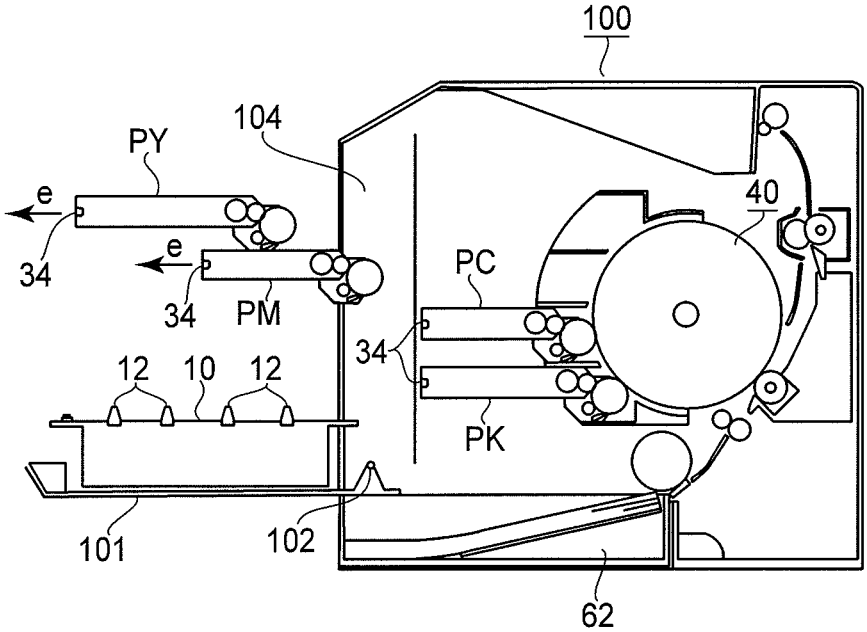
FIG. 2B is a sectional view of the electrophotographic image forming apparatus in the first preferred embodiment of the present invention when a couple of the process cartridges are being removed from the main assembly of the image forming apparatus.

First, referring to FIGS. 1-6, the electrophotographic image forming apparatus in the first preferred embodiment of the present invention is described. FIGS. 1 and 2 are drawings for describing the electrophotographic image forming apparatus in the first preferred embodiment. The electrophotographic image forming apparatus in this embodiment is a laser beam printer. Thus, the general structure and function of the image forming apparatus which will be described next are those of the laser beam printer.

Incidentally, in the following description of the image forming apparatuses in accordance with the present invention, the front side of the main assembly of the apparatus means the side from which an operator operates the image forming apparatus. Thus, the opposite side of the main assembly of the apparatus from the front side of the main assembly is the rear side (back side) of the main assembly as seen from the operator.

[General Description of Image Forming Apparatus]

FIG. 1(*a*) is an external perspective view of the image forming apparatus. FIG. 1(*b*) is a sectional view of the image forming apparatus. Referring to FIGS. 1(*a*) and 1(*b*), the image forming apparatus is a full-color laser beam printer, which uses an electrophotographic process, and is based on four primary colors. The image forming apparatus forms images on recording medium (recording paper) in response to electrical image formation signals inputted from an external host apparatus (unshown), such as a personal computer, an image reader, a facsimile apparatus (from which images are sent).

The main assembly 100 of the image forming apparatus comprises: a laser scanner unit 10; process cartridges P (PY, PM, PC, and PK) which are removably mountable in the main assembly 100; an intermediary transfer unit 40; a fixing apparatus 50; a sheet feeding-and-conveying unit 60; etc.

The sheet feeding-and-conveying unit 60 has a sheet feeder cassette 62, a sheet feeder roller 61, a separation pad 63, etc. The sheet feeder cassette 62 is removably mountable in the main assembly of the image forming apparatus, from the front side of the main assembly (front loading). The sheet feeder roller 61 is rotated in the counterclockwise direction (indicated by arrow mark a in FIG. 1(*b*)) with preset control timing. As the sheet feeder roller 61 is rotated, one of the layered recording medium sheets S in the sheet feeder cassette 62 is fed into the main assembly, while being separated from the rest, by the coordination between the sheet feeder roller 61 and separation pad 63. Then, the recording medium sheet S is conveyed to the nip between the intermediary unit 40 and a second transfer roller 41, by a pair of recording sheet conveyance rollers 64.

The photosensitive drum 21 is being rotated in the clockwise direction (indicated by arrow mark b in FIG. 1(*b*)). As the photosensitive drum 21 is rotated, an electrostatic latent image is formed on the peripheral surface of the photosensitive drum 21 by the beam L of laser light outputted from the exposing portion 16 of laser scanner unit 10. Then, the electrostatic latent image on the photosensitive drum 21 is developed by a development roller 32 into a visible image, that is, an image formed of toner (toner image).

After the formation of the toner image on the photosensitive drum 21, the toner image is transferred (first transfer) onto the intermediary transfer unit 40. In a case where a full-color image is formed, yellow, magenta, cyan, and black monochromatic images are developed on the four photosensitive drums 21 one for one, and are sequentially transferred (first transfer) onto the intermediary transfer unit 40.

After the transfer of the toner images onto the intermediary transfer unit 40, the toner images are transferred (second transfer) onto the recording sheet S as the recording sheet S is conveyed through the nip between the intermediary transfer unit 40 and a second transfer roller 41. The first transfer residual toner, that is, the toner remaining on the peripheral surface of the photosensitive drum 21 after the transfer of the toner image onto the intermediary transfer unit 40, is removed by a cleaning device 22, and is stored in the waste toner chamber 27 (FIG. 3(*b*)) of a photosensitive drum unit 20.

After the transfer of the toner images onto the recording sheet S, the sheet S is sent to the nip between the fixation film 51 and pressure roller 52 of a fixing apparatus 50 so that the toner images on the sheet S are fixed to the sheet S by being heated and pressed in the nip. After the fixation of the toner images to the sheet S in the nip, the sheet S is discharged into a delivery tray 70 by a pair of discharge rollers 71.

The second transfer residual toner, that is, the toner remaining on the surface of the intermediary transfer unit 40 after the transfer (second transfer) of the toner images onto the recording sheet S, is electrostatically adhered to the peripheral surface of the photosensitive drum 21, in the first transfer portion of the process cartridge PY, for example, and then, is removed by the cleaning device 22. After being removed by the cleaning device 22, the second transfer residual toner is stored in the waste toner chamber 27.

Figure 3:
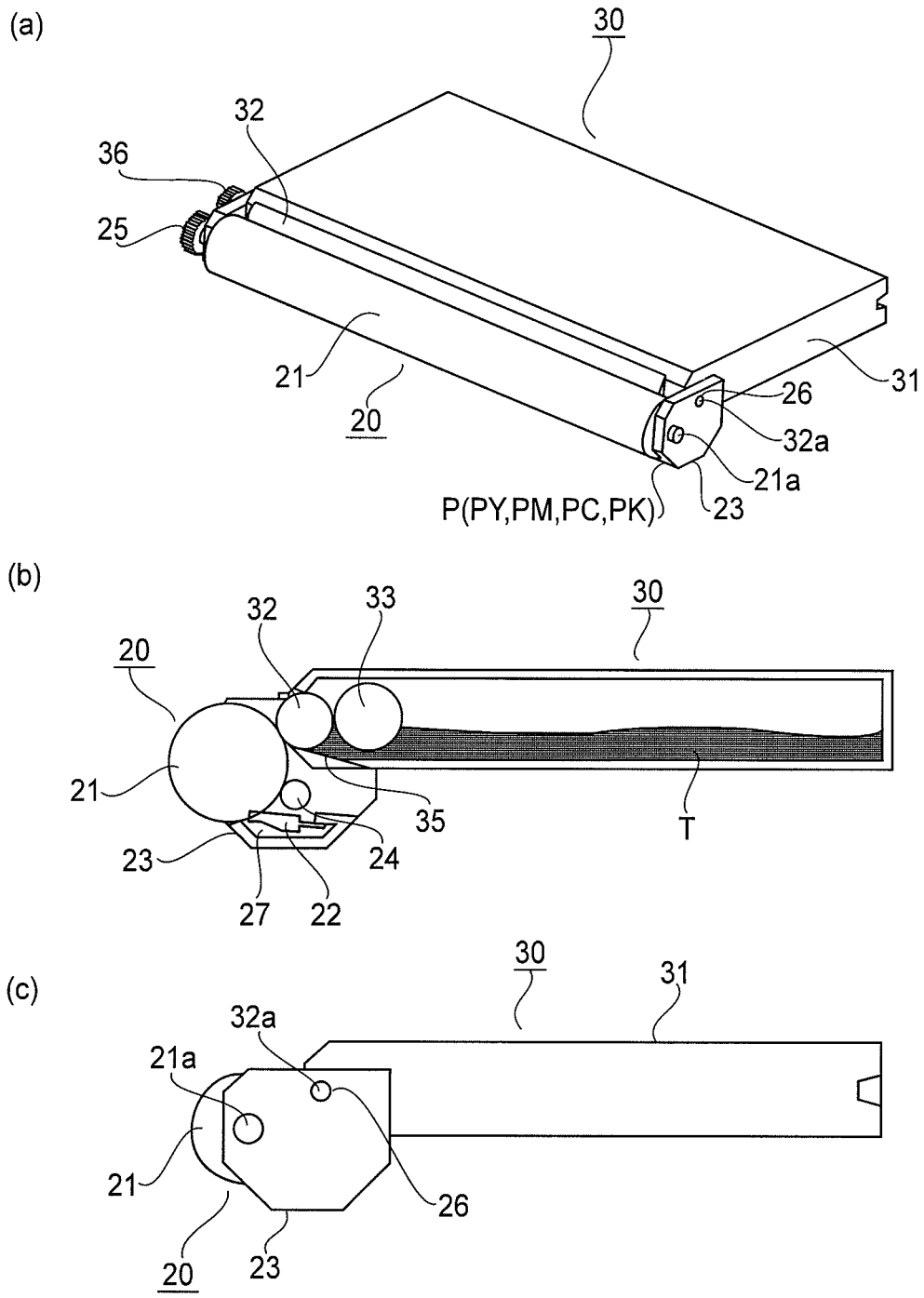
FIG. 3(*a*) is a perspective view of one of the process cartridges in the first preferred embodiment of the present invention, and FIG. 3(*b*) is a sectional view of the process cartridge in FIG. 3(*a*).

Each process cartridge has an integral combination of an electrophotographic photosensitive member and processing means (processing apparatus or processing apparatuses). In this embodiment, each process cartridge P has the photosensitive drum unit 20 (first unit) and development unit 30 (second unit), as shown in FIGS. 3(*a*) and 3(*b*).

The photosensitive drum unit 20 has a photosensitive drum 21, which is an electrophotographic photosensitive member. It has also: a charge roller 24 (charging means) which is a processing means for processing the photosensitive drum 21; the cleaning device 22 (cleaning means) for removing the developer T remaining on the peripheral surface of the photosensitive drum 21; and a photosensitive member case 23. The image forming apparatus in this embodiment uses multiple (four) photosensitive drum units (one for each process cartridge), which are mounted into the main assembly of the image forming apparatus in such a manner that they are vertically stacked in contact with the intermediary transfer unit 40, with the presence of preset intervals.

The development unit 30 is in engagement with the photosensitive drum unit 20, being enabled to be rotationally moved relative to the photosensitive drum unit 20 about its rotational axle. The development unit 30 has: a development device case 31 in which the developer T to be supplied to the photosensitive drum 21 is stored; a development roller 32 (developing means) which supplies the photosensitive drum 21 with the developer T; and a supply roller 33 which supplies the development roller 32 with the developer T in the developing device case 31.

Figure 4:
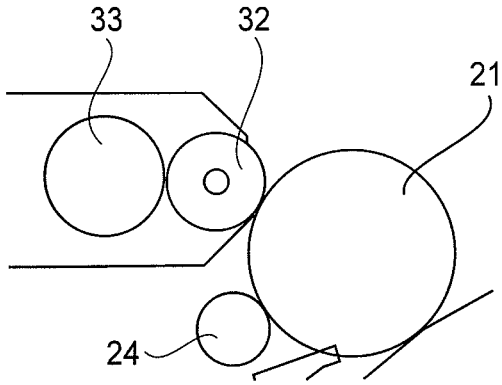
FIG. 4(*a*) is a schematic sectional view of the development roller and photosensitive drum of the image forming apparatus in the first preferred embodiment of the present invention when the development roller is in contact with the photosensitive drum, and FIG. 4(*b*) is a schematic sectional view of the development roller and photosensitive drum of the image forming apparatus in the first preferred embodiment of the present invention when the development roller is not in contact with the photosensitive drum.
Figure 4:
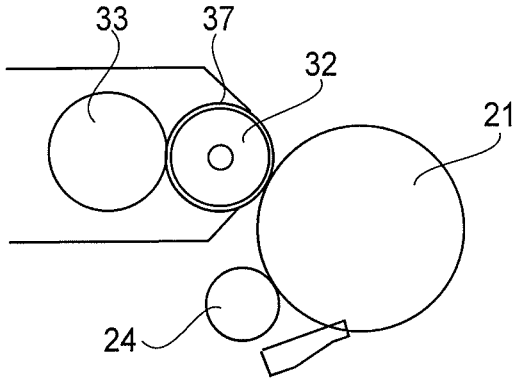

The development roller 32 may be in contact with the photosensitive drum 21 as shown in FIG. 4(*a*), or not in contact with the photosensitive drum 21 as shown in FIG. 4(*b*). When the development roller 32 is not in contact with the photosensitive drum 21 as shown in FIG. 4(*b*), a pair of spacers 37, which are in engagement with the lengthwise ends of the development roller 32, one for one, keep a preset distance between the development roller 32 and photosensitive drum 21 by being in contact with the photosensitive drum 21.

The laser scanner unit 10 (exposing apparatus) is on the front side of the group of the vertically stacked process cartridges PY, PM, PC, and PK; it is in the front portion of the apparatus main assembly. The laser scanner unit 10 scans (exposes) the peripheral surface of each photosensitive drum 21 with the beam L of laser light which it outputs while modulating the beam L according to the information regarding the images (one monochromatic image per primary color) to be formed, which is inputted from the external host apparatus.

[General Description of Process Cartridge]

Next, the process cartridges PY, PM, PC, and PK, which are removably mountable in the main assembly 100 of the image forming apparatus, are described.

FIG. 3(*a*) is an external perspective view of one of the process cartridges. The process cartridges PY, PM, PC, and PK have a mechanism for carrying out the electrophotographic image formation process. They are different only in the color of the toner they contains, and the amount of the toner therein.

The left and right directions of the process cartridges PY, PM, PC, and PK is parallel to the axial line of the photosensitive drum 21 in each cartridge. They are long and narrow assemblies, the lengthwise direction of which coincides with their left and right direction. The photosensitive drum 21 is rotatably supported at its lengthwise ends by a pair of bearings (unshown) which are at the right and left end of the process cartridge frame, one for one. The position of the photosensitive drum 21 relative to the intermediary transfer unit 40 is determined by the engagement between the rotational axle 21*a* of the photosensitive drum 21 and one of the four pairs of photosensitive drum positioning portions 43 (electrophotographic photosensitive member positioning portions) of the intermediary transfer unit 40. Incidentally, in this embodiment, the photosensitive drum positioning portions (electrophotographic photosensitive member positioning portions) belong to the intermediary transfer unit 40. However, this setup is not intended to limit the present invention in scope. For example, the image forming apparatus may be structured so that the electrophotographic photosensitive member positioning portions are parts of the intermediary transfer unit supporting portion of the main assembly 100 of the image forming apparatus.

One of the lengthwise ends of the abovementioned rotational axle 21*a* of the photosensitive drum 21 has a drum driving gear 25, through which the photosensitive drum 21 is driven, and therefore, may be referred to as the drive side hereafter. The corresponding lengthwise end of the rotational axle 32*a* of the development roller 32 has a development roller driving gear 36, through which the development roller 32 is driven. Hereafter, the left end of the process cartridge, that is, the opposite end from the drive side, has electrical contacts (unshown).

The force for driving the photosensitive drum 21 and development roller 32 is transmitted to the photosensitive drum 21 and development roller 32 through the meshing of the photosensitive drum driving gear 25 and development roller driving gear 36 of each of the process cartridges PY, PM, PC, and PK, and the corresponding driving force output gears (unshown) of the main assembly 100 of the image forming apparatus.

FIG. 3(*b*) is a sectional view of the opposite end portion of one of the process cartridges from the drive side, at a vertical plane perpendicular to the axial line of the photosensitive drum. FIG. 3(*c*) is a side view of the opposite end of the one of the process cartridges from the drive side. The photosensitive drum 21 is rotated by the driving force which it receives from the driving force output gear (unshown) of the main assembly 100 of the image forming apparatus. The charge roller 24 is of the contact type. It is placed in contact with the photosensitive drum 21 to charge the photosensitive drum 21, and is rotated by the rotation of the photosensitive drum 21. The cleaning device 22 is a blade formed of a piece of elastic rubber, and is in contact with the peripheral surface of the photosensitive drum 21 in such a manner that its cleaning edge is on the upstream side of its base in terms of the rotational direction of the photosensitive drum 21. The cleaning device 22 plays the role of removing the toner remaining on the peripheral surface of the photosensitive drum 21 after the first transfer of the toner image. After being removed by the cleaning device 22, the transfer residual toner is stored in the waste toner chamber 27 in the photosensitive member case 23.

The development unit 30 has: the development roller 32 which is a developing means; and the development blade 35. Referring to FIG. 3(*b*), the functional edge of the development blade 35 is in contact with the peripheral surface of the development roller 32. The development blade 35 plays the role of forming the toner borne on the peripheral surface of the development roller 32, into a thin layer of toner. Referring to FIG. 3(*c*), the photosensitive drum unit 20 has a pair of development roller positioning holes, which are at the lengthwise ends of the photosensitive drum unit 20, one for one. The development roller 32 is supported by the photosensitive drum unit 20. More specifically, the lengthwise ends of the rotational axle 32*a* of the development roller 32 are in the abovementioned development roller positioning holes, and therefore, the development roller 32 is properly positioned relative to the photosensitive drum 21.

[General Description of Cartridge Positioning Method]

Figure 2C:
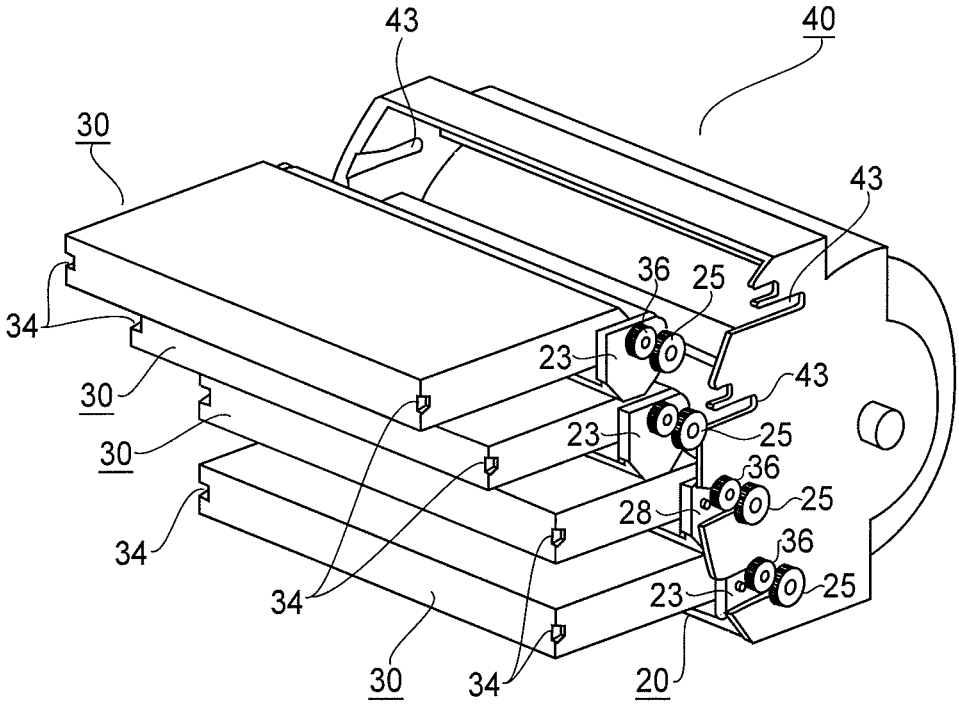
FIG. 2C is a perspective view of the combination of the development units, photosensitive member units, and intermediary transfer unit of the image forming apparatus shown in FIGS. 2(*a*) and 2(*b*).

FIGS. 2(*a*) and 2(*b*) are sectional views of the main assembly 100 of the image forming apparatus in this embodiment, and are for describing the method for replacing the process cartridges PY, PM, PC, and PK. FIG. 2C is a perspective view of the main assembly unit, and the process cartridges held by the main assembly unit. In FIG. 2C, the process cartridges to be replaced are being removed. It is for describing the mechanical structure for properly positioning the development cartridges as they are mounted into the main assembly unit.

The door 101, which can be rotationally opened or closed about its hinge 102, is on the front side (user side) of the main assembly 100 of the image forming apparatus. The door 101 exposes or covers the opening 104 of the apparatus main assembly 100. The opening 104 is for allowing the process cartridges P to be mounted into, or removed from, the apparatus main assembly 100. In order to open the door 101, the door 101 is to be rotated about the hinge 102 in the direction indicated by an arrow mark d in FIG. 2A. The laser scanner unit 10 is on the door 101, and is on the front side (user side) of the process cartridges PY, PM, PC, and PK in the apparatus main assembly 100. Thus, as the door 101 is rotationally opened, the laser scanner unit 10 is also rotationally moved frontward, exposing thereby the opening 104 of the apparatus main assembly 100. Therefore, it becomes possible to access the process cartridges PY, PM, PC, and PK in the apparatus main assembly 100. That is, it becomes possible to remove the process cartridges PY, PM, PC, and PK in the direction indicated by an arrow mark e in FIG. 2B.

When it is necessary to mount the process cartridges PY, PM, PC, and PK into the apparatus main assembly 100, the above described sequence for removing the process cartridges P is to be carried out in the reverse order. That is, the door 101 is to be opened, and then, the process cartridges PY, PM, PC, and PK are to be mounted into the apparatus main assembly 100.

Figure 5:
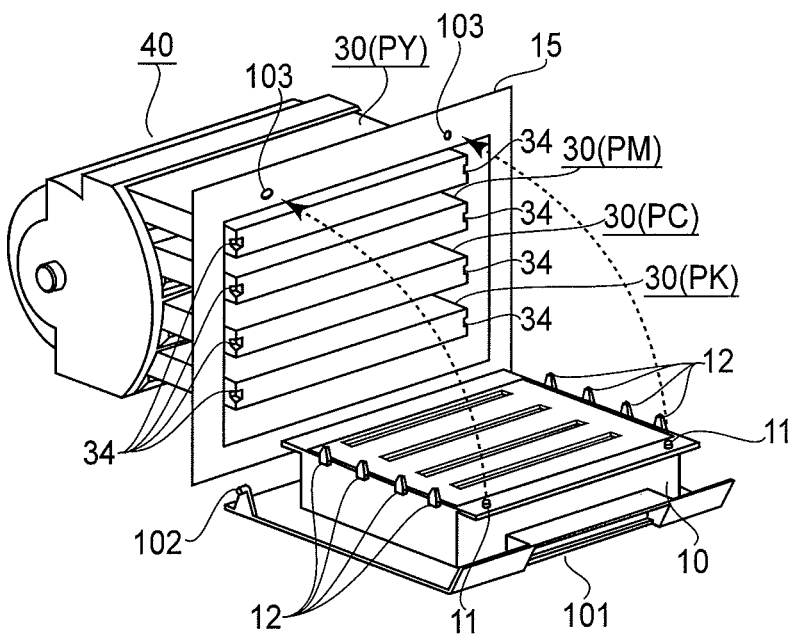
FIGS. 5(*a*) and 5(*b*) are perspective views of the combination of the intermediary transfer unit, process cartridges, apparatus frame, laser scanner unit, and door of the image forming apparatus in the first preferred embodiment of the present invention, and is for describing the cartridge positioning mechanism of the apparatus.
Figure 5:
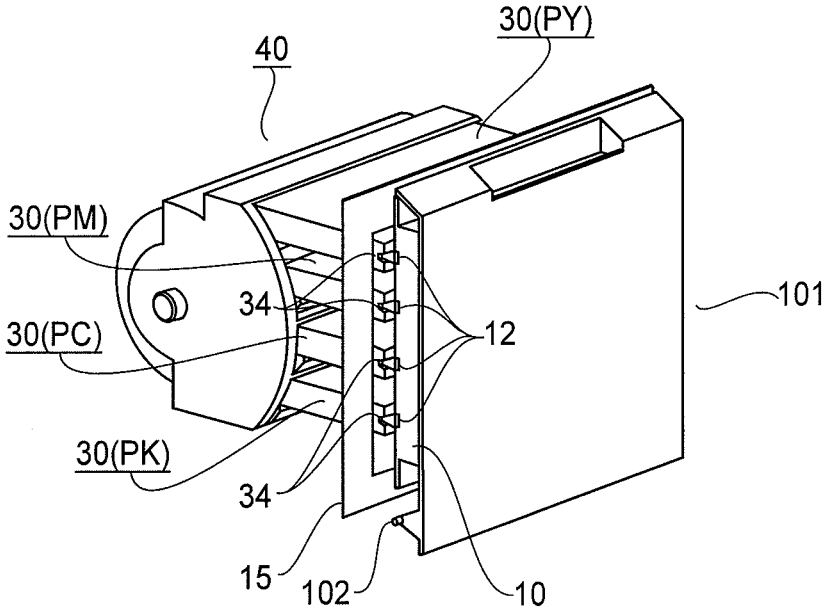

FIGS. 5(*a*) and 5(*b*) are perspective views of the combination of the intermediary transfer unit 40, process cartridges P, main frame 15 of the apparatus main assembly 100, laser scanner unit 10, and door 101 of the image forming apparatus when the door 101 is open to replace one or more of the process cartridges P and when the door 101 is closed, respectively. Since the process cartridges PY, PM, PC, and PK are the same in structure, one of them is described as a process cartridge P.

The laser scanner unit 10 has multiple pairs of rotation preventing portions 12 for stopping the rotation of the process cartridges P. Each of the rotation preventing portions 12 of the laser scanner unit 10 is the positioning means (second positioning portion) for properly positioning a process cartridge P relative to the laser scanner unit 10 relative to each other. As the door 101 is closed, each pair of rotation preventing portions 12 engage with the corresponding process cartridge P. More specifically, the laser scanner unit 10 has four pairs of rotation preventing portions 12, each pair of rotation preventing portions 12 being at the ends of the laser scanner unit 40, one for one, in terms of the direction perpendicular to the direction in which the process cartridge P is mounted into, or removed from, the apparatus main assembly 100.

The process cartridge P has a pair of development unit rotation preventing portions 34 as cartridge positioning portion, which engage with the rotation preventing portions 12 of the laser scanner unit 10. Each pair of the development roller rotation preventing portions 34 are at the lengthwise ends of the development unit 30, one for one, of each process cartridge P. They prevent the process cartridge P from rotationally moving, by engaging with the rotation preventing portion 12 of the laser scanner unit 10.

The main assembly 100 of the image forming apparatus has a pair of laser scanner unit positioning portions 103, which are the positioning means for properly positioning the laser scanner unit 10 relative to the apparatus main assembly 100. The laser scanner unit positioning means 103 are parts of the frame 15 of the apparatus main assembly 100, and engage with the laser scanner unit 10. The two laser scanner unit positioning portions 103 are in the end portions of the frame 15 in terms of the direction perpendicular to the direction in which the process cartridge P is mounted into, or removed from, the apparatus main assembly 100. One of them is a round hole, and the other is a rectangular hole.

The laser scanner unit 10 is held by the door 101, and is movable within a preset range. The laser scanner unit 10 has a pair of laser scanner unit positioning portions 11, which are the third positioning portions. As the door 101 is closed, the pair of laser scanner unit positioning portions 11 engage into the laser scanner unit positioning portions of the frame 10, being thereby properly positioned relative to the apparatus main assembly 100.

As the door 101 is closed, the laser scanner unit positioning portions 103 of the frame 15 of the main assembly 100 engage with the laser scanner unit positioning portions 11 of the laser scanner unit 10, one for one, whereby the laser scanner unit 10 is properly positioned relative to the apparatus main assembly 100. Incidentally, one of the laser scanner unit positioning portions 103 of the apparatus main assembly 100 is a round hole, and the other is a rectangular hole, as described above. Therefore, the laser scanner unit 10 is accurately positioned relative to the main assembly 100 of the image forming apparatus.

As the door 101 is closed, each pair of rotation preventing portions 12, which are at the ends of the laser scanner unit 10, one for one, engage with the pair of development unit rotation preventing portions of the development unit 30 of the corresponding process cartridge P. Thus, the development unit 30 of the process cartridge P is properly positioned relative to the laser scanner unit 10, ensuring that a clear path is provided between the laser scanner unit 10 and the peripheral surface of the photosensitive drum 21, for the beam L of laser light outputted from the laser scanner unit 10, in spite of a very small clearance between the adjacent two process cartridges P.

As the rotational axle 21*a* of the photosensitive drum 21 of the process cartridge P engages with the photosensitive drum positioning portions 43 (first positioning portions) of the intermediary transfer unit 40, the photosensitive drum 21 is properly positioned relative to the intermediary transfer unit 40 (FIG. 2C). Then, the door 101 is to be closed. As the door 101 is closed, the rotation preventing portions 12 of the laser scanner unit 10 engage with the development unit rotation preventing portions 34 of the process cartridge P, whereby the process cartridge P is properly positioned relative to the laser scanner unit 10. That is, the process cartridge P is properly position relative to the laser scanner unit 10 by the photosensitive drum positioning portions of the apparatus main assembly 100 (which engage with the photosensitive drum) and the rotation preventing portions 12 of the laser scanner unit 10.

Figure 6:
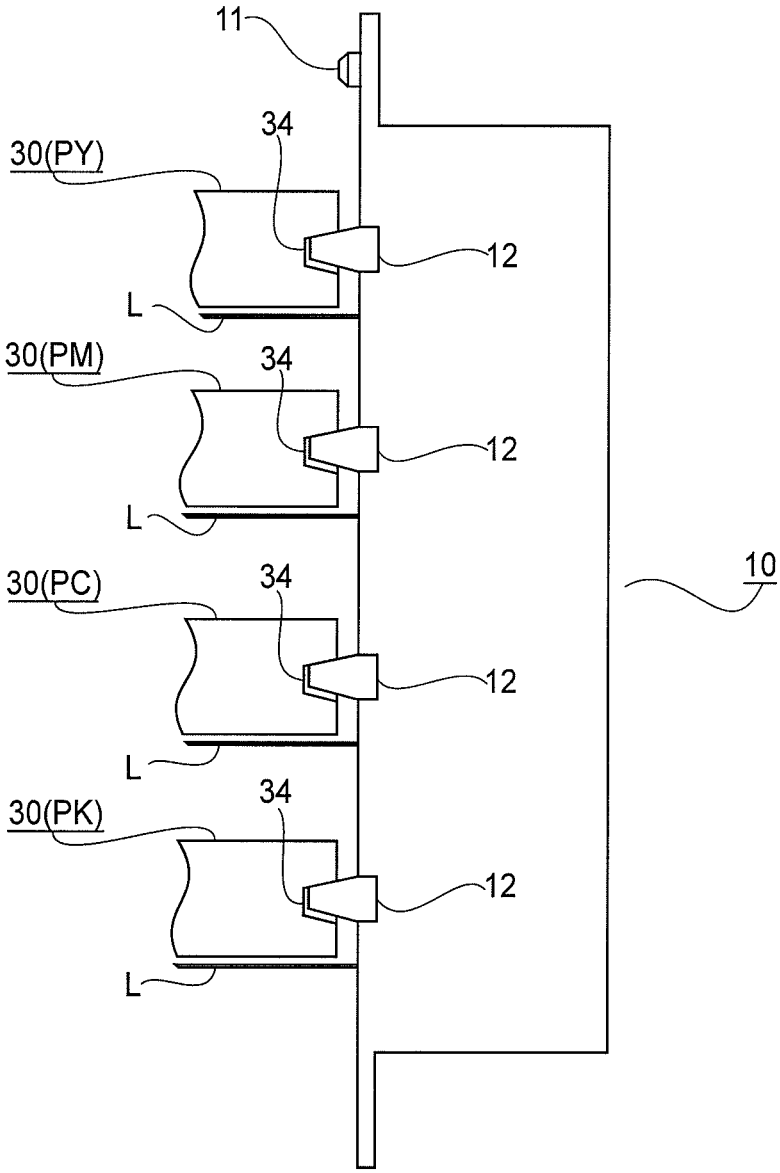
FIG. 6 is a side view of the combination of the process cartridges and laser scanner unit, and is for describing the cartridge positioning mechanism of the apparatus.

Further, one of the pair of rotation preventing portions 12 which are at the ends of the laser scanner unit 10 engages with the corresponding development unit rotation preventing portion 34 of the process cartridge P with the presence of a small gap between the two rotation preventing portions 12 and 34. The other of the pair of rotation preventing portions 12 engages with the other of the corresponding pair of development unit rotation preventing portions 34. Shown in FIG. 6 is the state of engagement between one of the rotation preventing portion 12 and the corresponding development unit rotation preventing portion 34, with the presence of gap between the two rotation preventing portions 12 and 34. As will be evident from FIG. 6, when one of the rotation preventing portion 12 is in engagement with the corresponding development unit rotation preventing portion 34, the top side of the outward end portion of the rotation preventing portion 12 is in contact with the top side of the outward portion of the development unit rotation preventing portion 34, but, the bottom side of the outward end portion of the rotation preventing portion 12 is not in contact with the bottom side of the outward portion of the development unit rotation preventing portion 34. Designing the rotation preventing portions 12 of the laser scanner unit 10, and the development unit rotation preventing portions 34 of the development unit 30 as described above, can prevent the problem that the warping, twisting, and/or the like deformation of the process cartridge P prevents the rotation preventing portions 12 and development rotation preventing portions 34 from properly engaging with each other.

It is not mandatory that one of the pair of rotation preventing portions 12 and the corresponding development unit rotation preventing portion 34 with the presence of the gap between the two rotation preventing portions 12 and 34 as described above. That is, the state of the contact may be such that the bottom side of the outward portion of the rotation preventing portion 12 is in contact with the bottom side of the inward portion of the development unit rotation preventing portion 34, but, the top side of the outward portion of the rotation preventing portion 12 is not in contact with the top side of the development unit rotation preventing portion 34. That is, the state of contact between one of the pair of rotation preventing portions 12 and the corresponding development unit rotation preventing portion 34 has only to be such that top or bottom side of one of the pair of rotation preventing portions 12 contacts the top or bottom side of the corresponding development unit rotation preventing portion 34, respectively.

As for the positional relationship between the development roller 32 and photosensitive drum 21, the development roller 32 is properly positioned relative to the photosensitive drum 21 by the development roller positioning hole 26 of the photosensitive drum unit 20 as described above. Further, the positioning of the process cartridge P (development unit 30) by the rotation preventing portions 12 of the laser scanner unit 10 is only in terms of the rotational direction of each process cartridge P. Therefore, it does not affect the development function of the process cartridge P.

In this embodiment, the development unit 30 is properly positioned relative to the laser beam unit 10 by the direct engagement between the pair of development unit rotation preventing portions 34 of the development unit 30, with which the lengthwise end portions of the development unit 30 are provided one for one, and the rotation preventing portions 12 with which the lengthwise end portions of the laser scanner unit 10 on the door 101 are provided one for one. Therefore, it is possible to minimize the gap between the development unit 30 and the path of the beam L of laser light outputted from the laser scanner unit 10.

Thus, the structural arrangement, in this embodiment, for positioning the development unit 30 of each of the process cartridges PY, PM, PC, and PK relative to the laser scanner unit 10 of the main assembly 100 of the image forming apparatus is different from the structural arrangement in accordance with any of the prior art, which positions the development unit 30 (process cartridges P) relative to the laser scanner unit 10, through the contacts, different in position from those in this embodiment, between the development unit 30 (process cartridges P) and the portions of the apparatus main assembly 100. Therefore, this embodiment has the following effects. That is, this embodiment can minimize the gap (space) between the development unit 30 and the path of the beam L of laser light outputted from the laser scanner unit 10 while ensuring that a clear path is provided for the beam L of laser light outputted from the laser scanner unit 10. Further, in the case of a process cartridge, the development unit 30 and photosensitive drum unit 20 of which are rotationally movable relative to each other as in this embodiment, one of the two units 30 and 20 is properly positioned by the laser scanner unit 10, and the other is properly positioned by the portion(s), other than the laser scanner unit 10, of the apparatus main assembly 100. Therefore, the internal components of the apparatus main assembly 100 can be efficiently positioned in terms of spatial efficiency. Thus, the image forming apparatus in this embodiment is simpler in the structure for positioning the development units 30 (process cartridges P), and smaller in the size of the apparatus main assembly 100, than any of the image forming apparatuses in accordance with the prior arts.

Embodiment 2

The image forming apparatus in the second preferred embodiment of the present invention is the same in general structure as the image forming apparatus in the first preferred embodiment. Thus, the members, components, etc., of the image forming apparatus in this embodiment, which are the same in function as the counterparts in the first embodiment are given the same referential codes as those given to the counterparts, and are not going to be described. In other words, the following description of the second preferred embodiment of the present invention is focused on the portions of the image forming apparatus in this embodiment, which are different in structure from the counterparts in the first embodiment.

Figure 7:
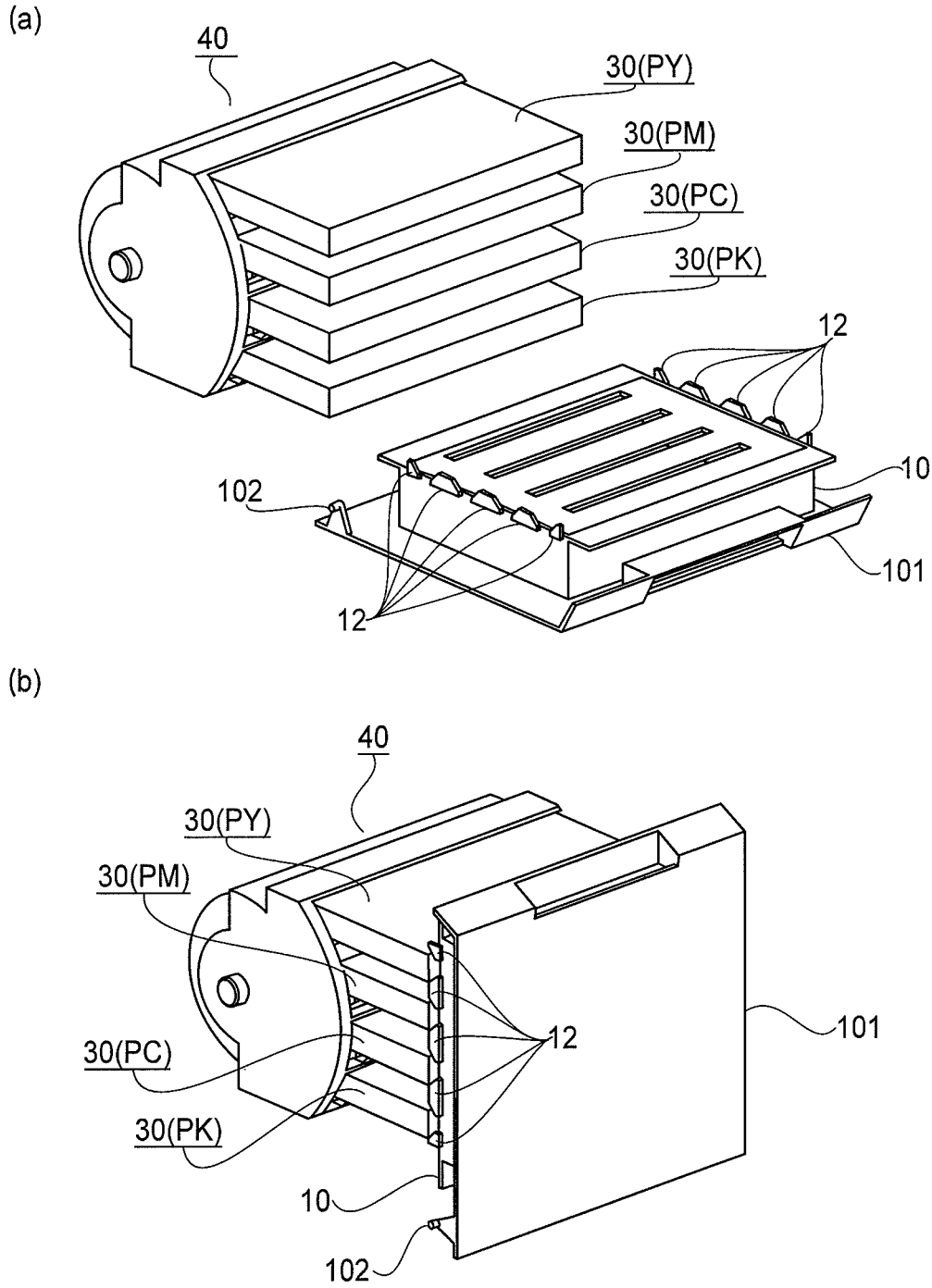
FIGS. 7(*a*) and 7(*b*) are perspective views of the combination of the intermediary transfer unit, process cartridges, laser scanner unit, and door of the image forming apparatus in the second preferred embodiment of the present invention, and is for describing the cartridge positioning mechanism of the apparatus.

FIG. 7(*a*) is a perspective view of the combination of the intermediary transfer unit 40, process cartridges P (development units 30), laser scanner unit 10, and door 101 when the door 101 is in its open position for the replacement of the process cartridge(s). FIG. 7(*b*) is a perspective view of the same combination as that in the FIG. 7(*a*), but when the door 101 is in its closed position.

The laser scanner unit 10 has five pairs of rotation preventing portions 12 for preventing the process cartridges P from rotationally moving. Each pair of the rotation preventing portions 12 of the laser scanner unit 10 are portions for positioning the corresponding process cartridge P relative to the laser scanner unit 10. Each pair of rotation prevention portions 12 of the laser scanner unit 10 are at the ends of the laser scanner unit 10, one for one, in terms of the direction parallel to the axial line of the photosensitive drum 21. Each rotation preventing portion 12 is in the form of a small projection. The second, third, and fourth pairs of rotation preventing portions 12, counting from the top side of the door 101, are for holding a preset distance between the process cartridges PY and PM, between the process cartridge PM and PC, and between process cartridges PC and PK, respectively. Thus, as the door 101 is closed, two pairs of rotation preventing portions 12 directly engage with the top and bottom edges of each process cartridge P, preventing thereby the process cartridge P (development unit 30) from rotationally moving. In other words, as the door 101 is closed, the process cartridges P are properly positioned relative to the laser scanner unit 10 so that a preset amount of gap is maintained between the beam L of laser light outputted from the laser scanner unit 10, and the corresponding process cartridge P.

In this embodiment, the image forming apparatus is structured so that as the door 101 is closed, each pair of rotation preventing portions 12 directly contact the frame of the corresponding process cartridge P. Therefore, it is unnecessary to provide the process cartridge P with the development unit rotation preventing portion 34 as in the first embodiment. Thus, the image forming apparatus in this embodiment is simpler in the cartridge positioning structure, being therefore lower in cost, than the image forming apparatus in the first embodiment.

That is, also in this embodiment, the rotation preventing portions 12 with which the laser scanner unit 10 is provided properly position the process cartridges P by coming directly in contact with the process cartridges P as described above. Thus, this embodiment also can reduce an image forming apparatus in the gap between the development unit 30 and the corresponding beam L of laser light outputted from the laser scanner unit 10.

Therefore, this embodiment also can accurately position the development unit 30 and laser scanner unit 10 relative each other, making it therefore possible to minimizing the gap between the development unit 30 and the path of the corresponding beam L of light from the laser scanner unit 10 while ensuring that there is a clearance for the beam L of laser light as can the first embodiment described above. In other words, this embodiment also makes it possible to efficiently position the internal components of the main assembly 100 of an image forming apparatus in terms of spatial efficiency. Therefore, it can provide an image forming apparatus which is simpler in the cartridge positioning structure of the main assembly 100, and is smaller in the size of the main assembly 100. In addition, not only is the image forming apparatus in this embodiment simper in the cartridge positioning structure, but also, lower in cost, than the image forming apparatus in the first embodiment.

Embodiment 3

The general structure of the image forming apparatus in the third embodiment is similar to that of the image forming apparatus in the first embodiment. Thus, the members, components, etc., of the image forming apparatus in this embodiment, which are similar in function to the counterparts in the first embodiment are given the same referential codes as those given to the counterparts, and are not going to be described. In other words, the following description of the third preferred embodiment of the present invention is focused on the portions of the image forming apparatus in this embodiment, which are different in structure from the counterparts in the first embodiment.

Figure 8:
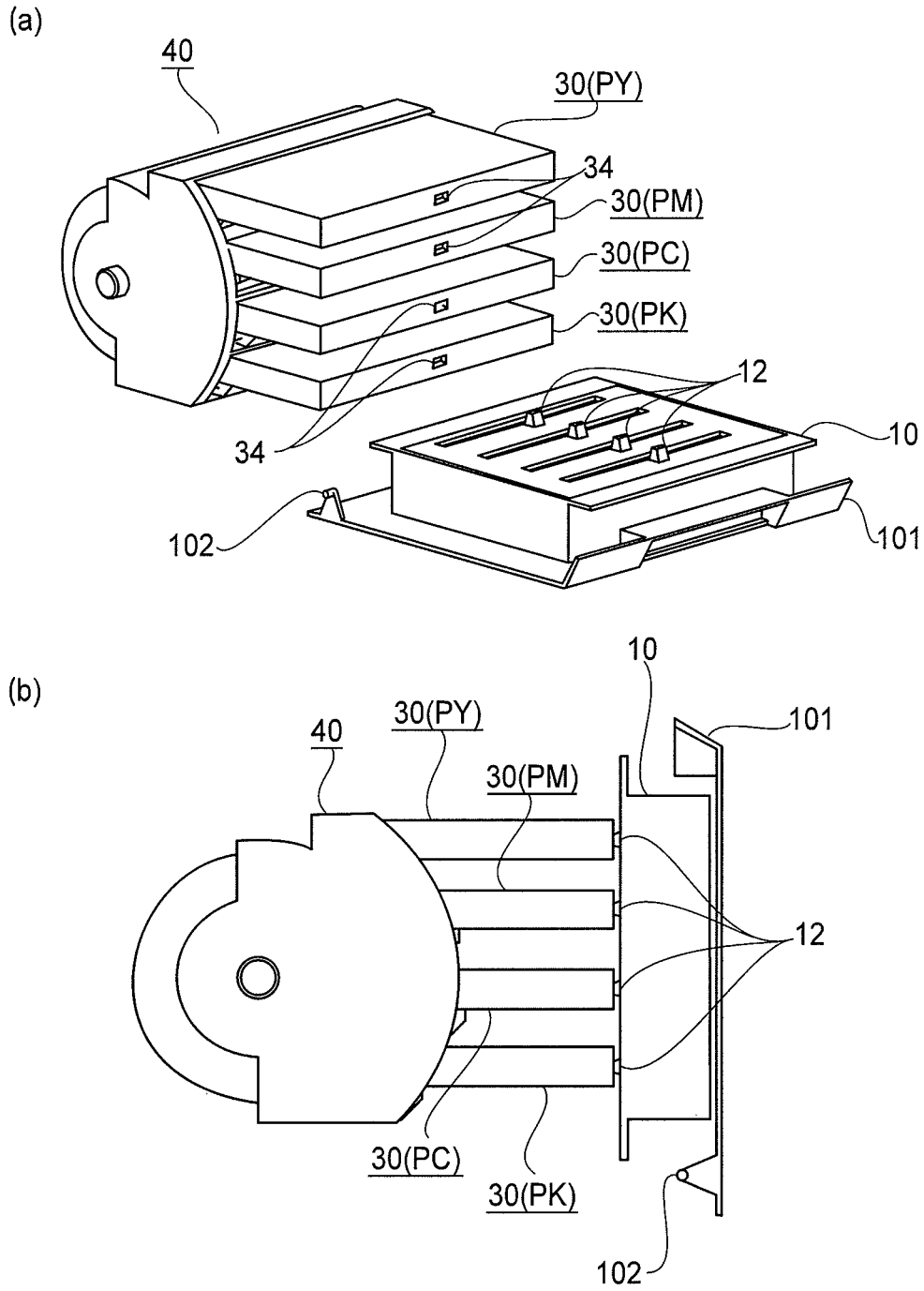
FIG. 8(*a*) is a perspective view of the combination of the intermediary transfer unit, process cartridges, laser scanner unit, and door of the image forming apparatus in the third preferred embodiment of the present invention, and is for describing the cartridge positioning mechanism of the apparatus.

FIG. 8(*a*) is a perspective view of the combination of the intermediary transfer unit 40, process cartridges PY, PM, PC, and PK, laser scanner unit 10, and door 101 when the door 101 is in its open position for the replacement of the process cartridge(s). FIG. 8(*b*) is a perspective view of the same combination as that in the FIG. 8(*a*), but when the door 101 is in its closed position.

The laser scanner unit 10 has four rotation preventing portions 12 for preventing the process cartridges P from rotationally moving. The rotation preventing portions 12 of the laser scanner unit 10 are portions for properly positioning the corresponding process cartridge P relative to the laser scanner unit 10. Each rotation preventing portion 12 of the laser scanner unit 10 is at the center of the laser scanner unit 10 in terms of the direction perpendicular to the direction in which the process cartridges P are mounted into, or removed from, the apparatus main assembly 100. Each rotation preventing portion 12 is in the form of a small projection. The rotation preventing portions 12 are for accurately positioning the development units 30 of the properly positioned adjacent two process cartridges P, with the presence of a preset gap.

Further, each process cartridge P has a development unit rotation preventing portion 34 as a development unit rotation preventing portion which engages with one of the rotation preventing portions 12 of the laser scanner unit 10. The development unit rotation preventing portion 34 is in the form of a recess. The development unit rotation preventing portion 34 is at the center of the development unit 30 of the process cartridge P in terms of the direction perpendicular to the direction in which the process cartridge P is mounted into, or removed from, the apparatus main assembly 100. As the door 101 is closed, the development unit rotation preventing portion 34 of each process cartridge P, which is in the form of a recess, engages with the corresponding development unit rotation preventing portion 12 of the laser scanner unit 10, which is in the form of a projection, whereby the process cartridge P (development unit 30) is prevented from rotationally moving. In other words, each process cartridge P is accurately positioned so that a preset amount of gap is maintained between each process cartridge P and the path of the corresponding beam L of laser light outputted from the laser scanner unit 10.

Also in this embodiment, as the door 101 is closed, each of the rotation preventing portions 12, with which the laser scanner unit 10 on the door 101 is provided, accurately positions the corresponding process cartridge P by directly engaging with the development unit rotation preventing portion 34 of the development unit 30, which is at the center of the development unit 30. Thus, this embodiment also can reduce an image forming apparatus in the gap between the development unit 30 and the path of the corresponding beam L of laser light outputted from the laser scanner unit 10.

Therefore, this embodiment also can minimize the gap (space) between the development unit 30 and the path of the corresponding beam L of light from the laser scanner unit 10 while ensuring that there is a clearance for the beam L of laser light as can the embodiment described above. In other words, this embodiment also makes it possible to efficiently position the internal components of the main assembly of an image forming apparatus in terms of spatial efficiency. Therefore, it can provide an image forming apparatus which is simpler in the cartridge positioning structure of the main assembly, and is smaller in the size of the main assembly, than any of the image forming apparatuses in accordance with the prior arts.

Embodiment 4

The general structure of the image forming apparatus in the fourth embodiment is similar to that of the image forming apparatus in the first embodiment. Thus, the members, components, etc., of the image forming apparatus in this embodiment, which are similar in function to the counterparts in the first embodiment, are given the same referential codes as those given to the counterparts, and are not going to be described. In other words, the following description of the third preferred embodiment of the present invention is focused on the portions of the image forming apparatus in this embodiment, which are different in structure from the counterparts in the first embodiment.

Figure 9:
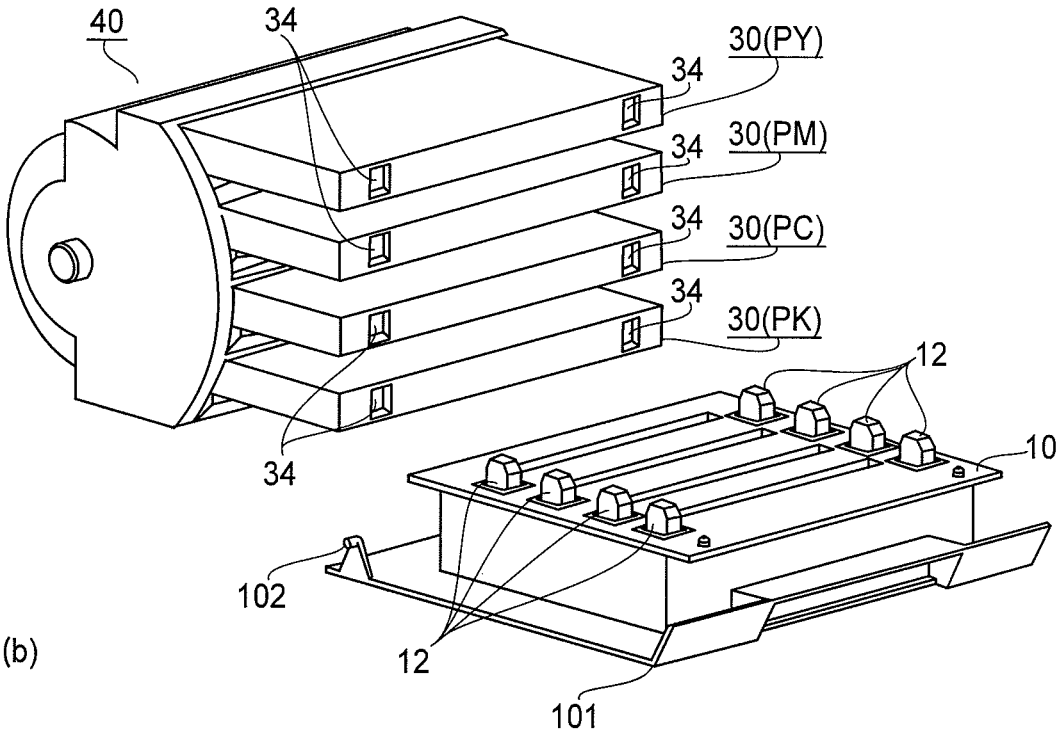
FIG. 9(*a*) is a perspective view of the combination of the intermediary transfer unit, process cartridges, laser scanner unit, and door of the image forming apparatus in the fourth preferred embodiment of the present invention, and is for describing the cartridge positioning mechanism of the apparatus, and FIG. 9(*b*) is a side of view of the combination of the intermediary transfer unit, process cartridges, laser scanner unit, and door of the image forming apparatus in the fourth preferred embodiment of the present invention, and is for describing the cartridge positioning mechanism of the apparatus.
Figure 9:
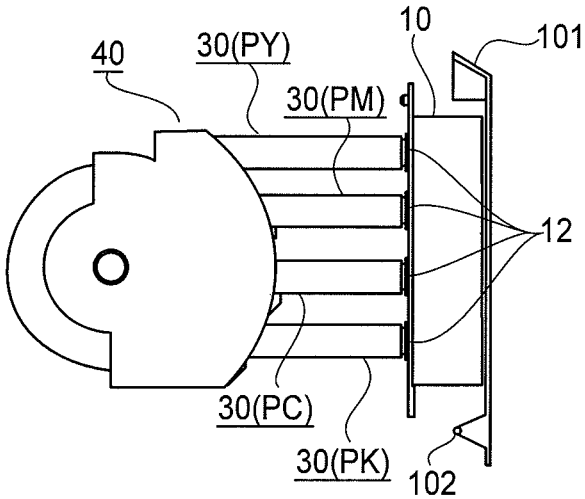

FIG. 9(*a*) is a perspective view of the combination of the intermediary transfer unit 40, process cartridges PY, PM, PC, and PK, laser scanner unit 10, and door 101 when the door 101 is in its open position for the replacement of the process cartridge(s). FIG. 9(*b*) is a side view of the same combination as that in FIG. 9(*a*) when the door 101 is in its closed position.

Figure 10:
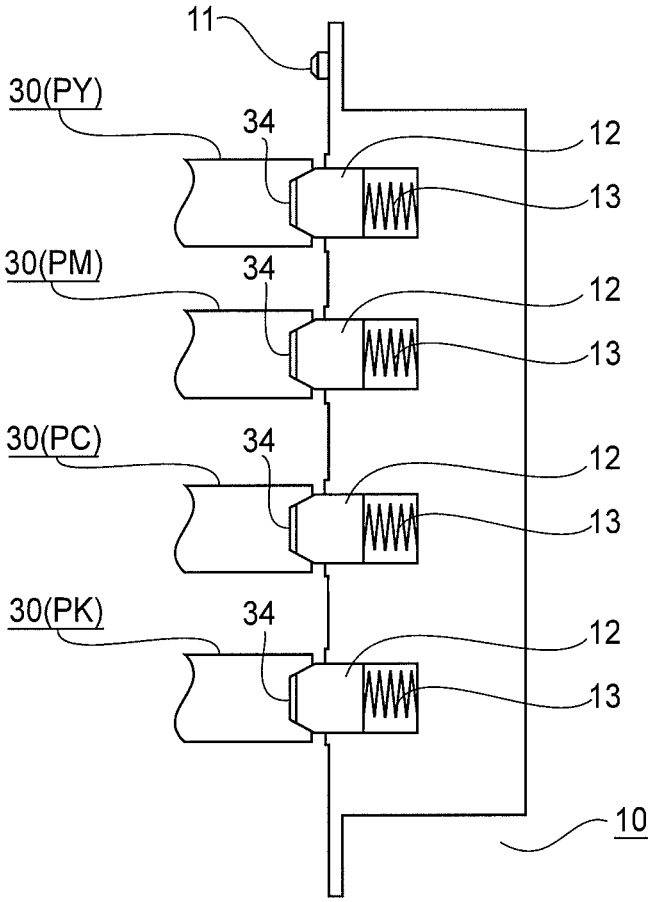
FIG. 10 is a side view of the combination of the process cartridges and laser scanner unit in the fourth preferred embodiment of the present invention, and is for describing the mechanism for keeping the development unit rotation preventing portions pressured.

The laser scanner unit 10 has four pairs of rotation preventing portions 12 for preventing the process cartridges P from rotationally moving. Each pair of rotation preventing portions 12 of the laser scanner unit 10 are portions for properly positioning the corresponding process cartridge P relative to the laser scanner unit 10. Referring to FIG. 10, the structure of the laser scanner unit 10 is such that each rotation prevention portion 12 of the laser scanner unit 10 is under the pressure generated by a rotation preventing spring 13 in the direction which is roughly the same as the direction in which the process cartridge P is pressed for positioning.

Each rotation preventing portion 12 in this embodiment is in the form of a small projection. The rotation preventing portions 12 are for accurately positioning the development units 30 of the properly positioned adjacent two process cartridges P (PY, PM, PC, and PK), with the present of a preset interval.

Further, each process cartridge P has a pair of development unit rotation preventing portion 34 as cartridge positioning portions which engage with the corresponding pair of rotation preventing portion 12 of the laser scanner unit 10. The development unit rotation preventing portion 34 is in the form of a recess. Each pair of development unit rotation preventing portion 34 are at the ends of the development unit 30 of the process cartridge P, one for one, in terms of the direction perpendicular to the direction in which the process cartridge P is mounted into, or removed from, the apparatus main assembly 100. As the door 101 is closed, each of the development unit rotation preventing portions 34 of the process cartridge P, which is in the form of a recess, engages with the corresponding development unit rotation preventing portion 12 of the laser scanner unit 10, which is in the form of a projection, whereby the process cartridge P (development unit 30) is prevented from rotationally moving. In other words, the process cartridges P are positioned so that a preset amount of gap is maintained between each process cartridge P and the path of the corresponding beam L of laser light outputted from the laser scanner unit 10.

Also in this embodiment, as the door 101 is closed, each of the rotation preventing portions 12, with which the laser scanner unit 10 on the door 101 is provided, functions to properly position the corresponding process cartridge P by directly engaging with the corresponding development unit rotation preventing portion 34. Thus, this embodiment also can reduce an image forming apparatus in the gap between the development unit 30 and the path of the corresponding beam L of laser light outputted from the laser scanner unit 10. Further, the laser scanner unit 10 is structured so that each of the rotation preventing portions 12 is under the pressure generated by the rotation preventing spring 13 in the direction which is roughly the same as the direction in which the process cartridge P is pressed for positioning. Therefore, the members dedicated for keeping the process cartridges P pressured are unnecessary.

Figure 11:
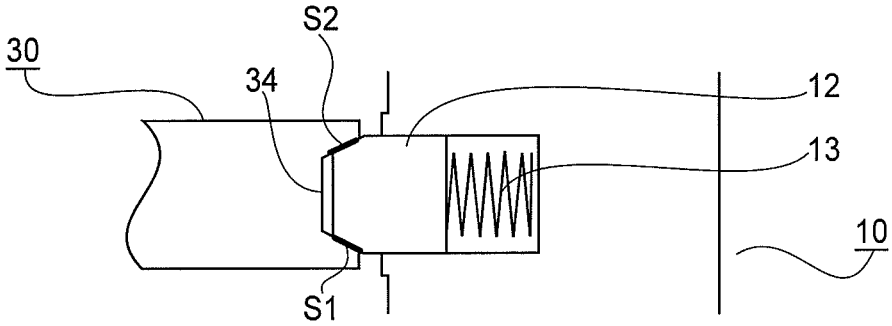
FIG. 11 is a side view of the combination of one of the process cartridges, and the development unit rotation preventing portion of the laser scanner unit, and is for describing the mechanism for keeping the development unit rotation portion pressured, which is in the state in which the process cartridge and development unit rotation preventing portion are in contact with each other.

FIG. 11 is an enlarged sectional view of one of the development unit rotation preventing portions 34 and the corresponding rotation preventing portion 12, in this embodiment, when the two portions 34 and 12 are in contact with each other. The laser unit scanner 10 and process cartridge P (development unit 30) are structured so that the areas of contacts S1 and S2 between each rotation preventing portion 12 and corresponding development unit rotation preventing portion 34 are slanted. Therefore, the two portions 34 and 12 engage with each other with no play between them. Further, the areas of contact of the rotation preventing portion 12, and the areas of contact of the development unit rotation preventing portion 34 are provided with an electrical contact for supplying the processing portion of the corresponding process cartridge with electric power. Therefore, the electric power for generating the bias to be applied to the development roller, for example, can be supplied to the processing portion through the areas of contact S1 and S2. Positioning the electrical contacts as described above can make the contact pressure greater than the pressure applied to the process cartridge P. Therefore, it is ensured that the electrical contacts remain in contact. Moreover, this structural arrangement makes it unnecessary to provide portions dedicated to the electrical connection between the apparatus main assembly 100 and the process cartridge P. Further, it ensures that the process cartridges P remain properly positioned.

In other words, the structural arrangement, in this embodiment, for positioning the development unit 30 of each of the process cartridges PY, PM, PC, and PK relative to the laser scanner unit 10 of the main assembly 100 of the image forming apparatus is different from the structural arrangement in accordance with any of the prior art, which positions the development unit 30 (process cartridges P) relative to the laser scanner unit 10, through the contacts, different in position from those in this embodiment, between the development unit 30 (process cartridges P) and the portions of the apparatus main assembly 100. Therefore, this embodiment has the following effects. That is, this embodiment can minimize the gap (space) between the development unit 30 and the path of the beam L of laser light outputted from the laser scanner unit 10 while ensuring that a clear path is provided for the beam L of laser light outputted from the laser scanner unit 10. Further, this embodiment eliminates the need for the members dedicated to the pressing of the process cartridges P. Thus, this embodiment makes it possible to efficiently position the internal components of the apparatus main assembly 100 in terms of spatial efficiency. In other words, the present invention can provide an image forming apparatus which is simpler in the cartridge positioning structure, and smaller in the main assembly, than any of the image forming apparatuses in accordance with the prior arts.

Embodiment 5

The general structure of the image forming apparatus in the fifth embodiment is similar to that of the image forming apparatus in the fourth embodiment. Thus, the members, components, etc., of the image forming apparatus in this embodiment, which are similar in function to the counterparts in the first embodiment, are given the same referential codes as those given to the counterparts, and are not going to be described. In other words, the following description of the fifth preferred embodiment of the present invention is focused on the portions of the image forming apparatus in this embodiment, which are different in structure from the counterparts in the fourth embodiment.

Figure 12:
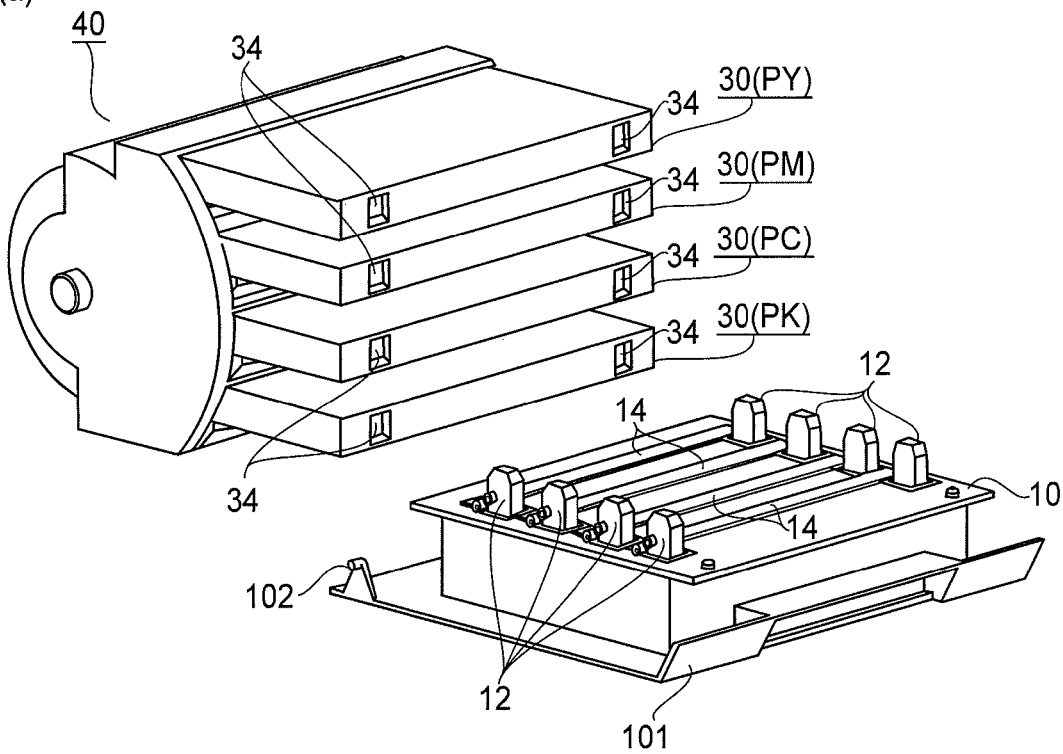
FIG. 12(*a*) is a perspective view of the combination of the intermediary transfer unit, process cartridges, laser scanner unit, and door of the image forming apparatus in the fifth preferred embodiment of the present invention, and is for describing the cartridge positioning mechanism of the apparatus.
Figure 12:
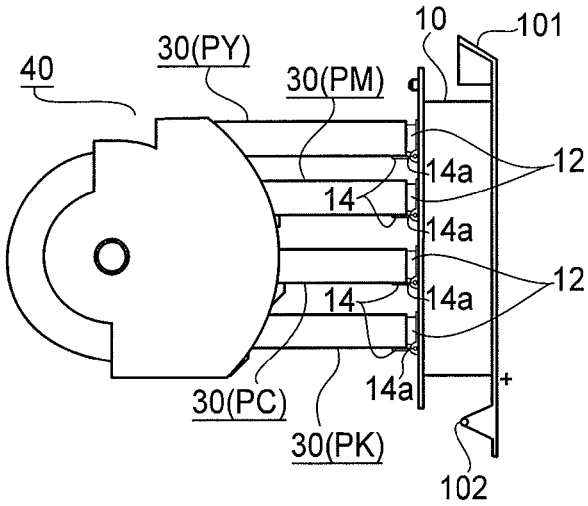

FIG. 12(*a*) is a perspective view of the combination of the intermediary transfer unit 40, process cartridges PY, PM, PC, and PK, laser scanner unit 10, and door 101 in this embodiment when the door 101 is in its open position for the replacement of the process cartridge(s). FIG. 12(*b*) is a side view of the same combination as that in the FIG. 12(*a*) when the door 101 is in its closed position.

Figure 13:
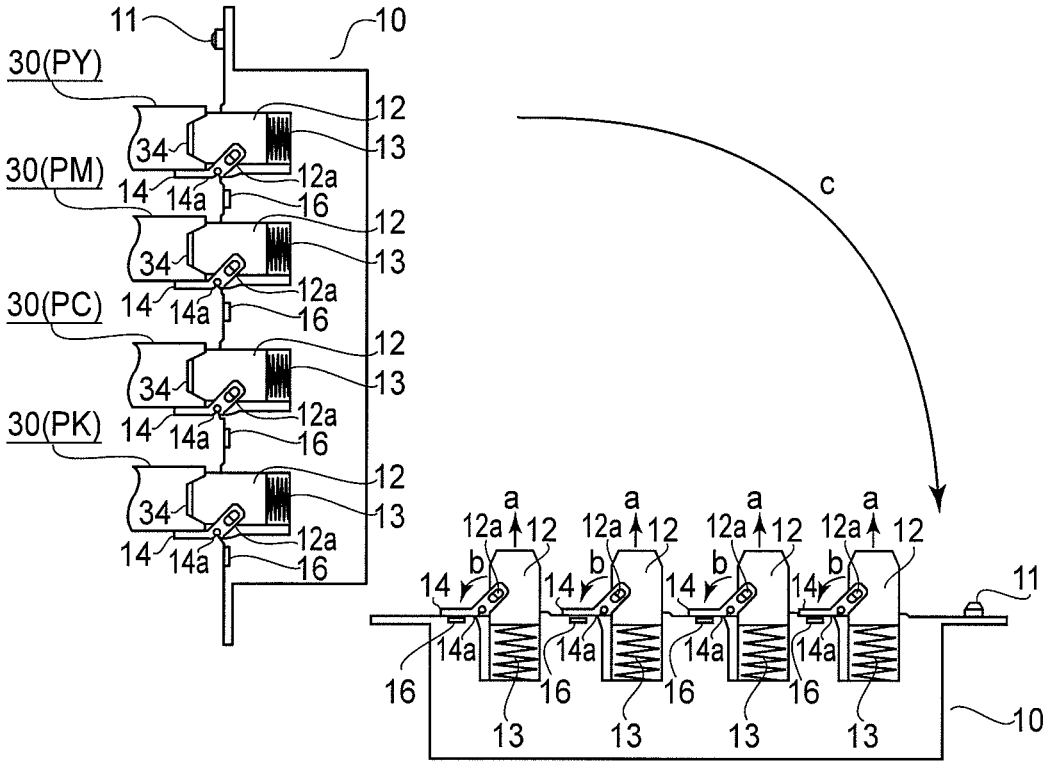
FIG. 13 is a side view of the combination of the process cartridges and laser scanner unit in the fifth preferred embodiment of the present invention, and is for describing the mechanism for opening or closing the laser beam outlet shutter of the laser scanner unit.

FIG. 13 is a side view of the combination of the process cartridges P and laser scanner unit 10 in the fifth preferred embodiment of the present invention when the door 101 for the replacement of the process cartridge(s) is in its closed position.

The laser scanner unit 10 has four pairs of rotation preventing portions 12 for preventing the process cartridges P from rotationally moving. Each pair of the rotation preventing portions 12 of the laser scanner unit 10 are portions for properly positioning the corresponding process cartridge P relative to the laser scanner unit 10.

Referring to FIG. 13, the laser scanner unit 10 is structured so that each of the rotation preventing portions 12 is under the pressure generated by a spring 13 in the direction which is roughly the same as the direction in which the process cartridge is pressed for positioning. Further, the laser scanner unit 10 is structured so that as the door 101 is opened, each rotation preventing portion 12 engages with the corresponding shutter 14 for covering the exposure window 16 of the abovementioned exposing apparatus, and rotates the shutter 14 about its rotational axis 14*a*. As the door 101 is opened, the laser scanner unit 10 moves in the direction indicated by an arrow mark c, and each rotation preventing portion 12 moves in the direction indicated by an arrow mark a. Thus, the process cartridge P is freed from the pressure under which it was.

Also in this embodiment, the development unit 30 (process cartridges P) are properly positioned relative to the laser scanner unit 10 by the direct engagement between the development unit rotation preventing portions 34 of the development unit 30, and the rotation preventing portions 12 of the laser scanner unit 10 on the door 101, one for one. Therefore, the gap between each of the development units 30, and the path of the corresponding beam L of laser light outputted from the laser scanner unit 10 does not need to be as wide as that in any of the image forming apparatuses in accordance with the prior arts, as descried above. Further, each of the rotation preventing portions 12 is under the pressure generated in the direction which is roughly parallel to the process cartridge positioning direction. Therefore, the apparatus main assembly 100 does not need to be provided with the members dedicated to the pressing of the process cartridges. Moreover, each rotation preventing portion 12 is in engagement with the shutter 14 with its engaging portion 12*a*. Therefore, as the pressure which is being applied to the process cartridge P is removed, the rotation preventing portion 12 moves in the direction indicated by the arrow mark a, causing thereby the shielding member 14 to cover the exposure window of the exposing apparatus.

That is, the structural arrangement, in this embodiment, for positioning the development unit 30 of each of the process cartridges PY, PM, PC, and PK relative to the laser scanner unit 30 of the main assembly 100 of the image forming apparatus is different from the structural arrangement in accordance with any of the prior art, which positions the development unit 30 (process cartridges P) relative to the laser scanner unit 10, through the contacts different in position from those in this embodiment, between the development unit 30 (process cartridges P) and the portions of the apparatus main assembly 100. Therefore, this embodiment has the following effects. That is, this embodiment can minimize the gap (space) between the development unit 30 and the path of the beam L of laser light outputted from the laser scanner unit 10 while ensuring that a clearance is provided for the beam L of laser light outputted from the laser scanner unit 10. Further, this embodiment eliminates the need for the members dedicated to the pressing of the process cartridges P. Moreover, this embodiment can simplify the mechanism for covering the exposure window of the exposing apparatus. Thus, this embodiment makes it possible to efficiently position the internal components of the apparatus main assembly 100 in terms of spatial efficiency. In other words, the present invention can provide an image forming apparatus which is simpler in the cartridge positioning structure, and smaller in the main assembly, than any of the image forming apparatuses in accordance with the prior arts.

[Miscellanies]

In the preceding embodiments of the present invention, the laser scanner unit 10 is attached to the door 101, being allowed to move within a preset range, and as the door 101 is closed, the laser scanner unit 10 is accurately positioned relative to the frame 15 of the main assembly 100 of the image forming apparatus. However, these embodiments are not intended to limit the present invention in scope. That is, the present invention is also effectively applicable to an image forming apparatus, the laser scanner unit 10 of which is immovably attached to the door 101, but, is not accurately positioned relative to the frame 15 of the apparatus main assembly 100. That is, according to the present invention, the development unit 30 of the process cartridge P is accurately positioned by the rotation preventing portions 12 of the laser scanner unit 10. Thus, even if the laser scanner unit 10 on the door 101 is not movable relative to the door 101, it is ensured that a clear path is provided for the beam L of laser light outputted from the laser scanner unit 10, between the laser scanner unit 10 and the peripheral surface of the photosensitive drum 21.

Figure 14:
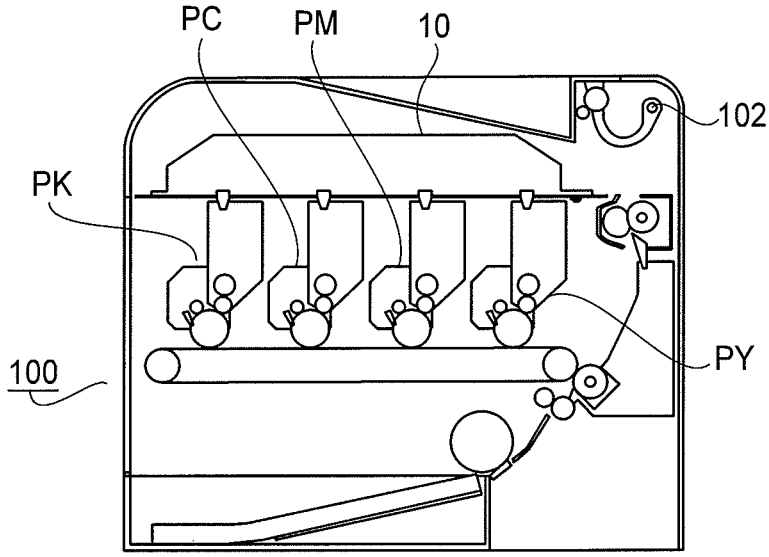
FIG. 14(*a*) is a sectional view of the image forming apparatus which is in one of the miscellaneous embodiments of the present invention and is structured so that its door for mounting or removing process cartridges opens upward, and which is in the state in which the door is in its closed position.
Figure 14:
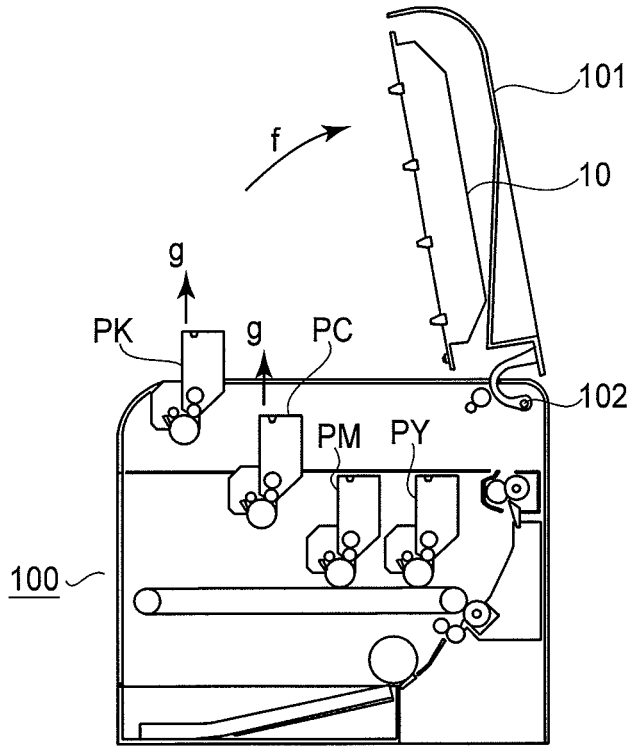

Also in the preceding preferred embodiments described above, the door 101 was rotationally moved frontward of the main assembly 100 of the image forming apparatus to replace the process cartridge(s) in the apparatus main assembly 100. However, this structural arrangement is not intended to limit the present invention in scope. That is, referring to FIGS. 14(*a*) and 14(*b*), the present invention is also compatible with an image forming apparatus structured so that the door 101 is to be rotationally moved upward about the hinge 102 in the direction indicated by an arrow mark in FIG. 14(*b*). In such a case, it is in the upward direction indicated by an arrow mark g that the process cartridges PY, PM, PC, and PK are to be removed. The application of the present invention to the above described structural design for an image forming apparatus can provide an image forming apparatus which is significantly smaller in the gap between the development unit 30 of each of the process cartridges PY, PM, PC, and PK in the main assembly of the image forming apparatus, and the path of the beam L of laser light outputted from the laser scanner unit 10, and therefore, in the front-to-rear dimension, than any of the image forming apparatuses in accordance with the prior arts.

Figure 16:
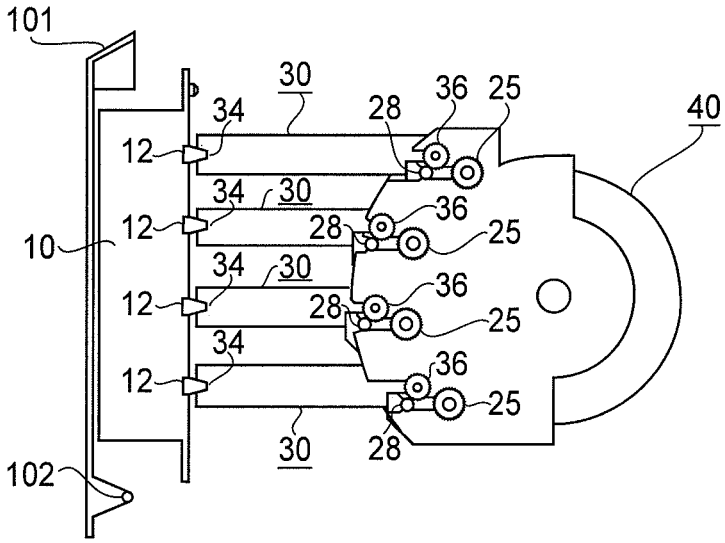
FIG. 16 is a side view of the combination of the door, laser scanner unit, process cartridges, and intermediary transfer unit of the image forming apparatus which is in the above-mentioned miscellaneous embodiment of the present invention and employs the process cartridges, the development unit and photosensitive drum unit of which are independently replaceable from each other, and is for describing the process cartridge positioning mechanism of the image forming apparatus.
Figure 15:
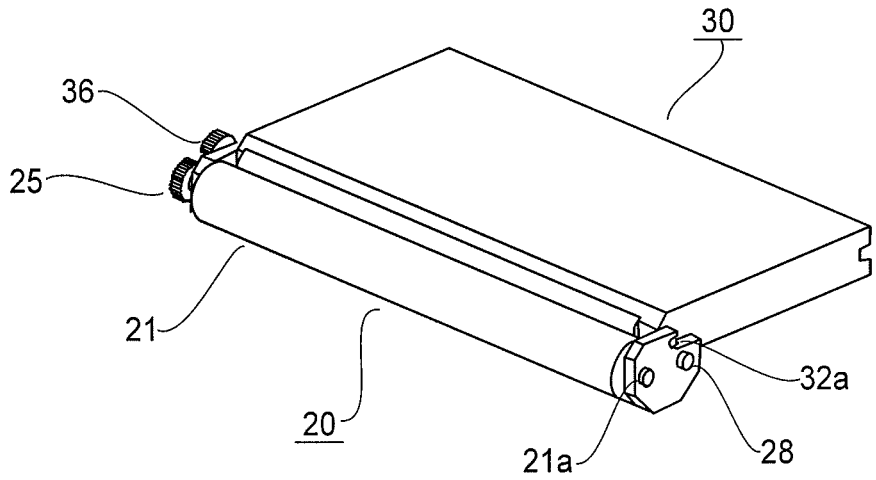
FIG. 15(*a*) is a perspective view of the process cartridge, which is in another of the miscellaneous embodiment of the present invention, and the development unit and photosensitive drum unit of which are independently replaceable from each other and are in engagement with each other.
Figure 15:
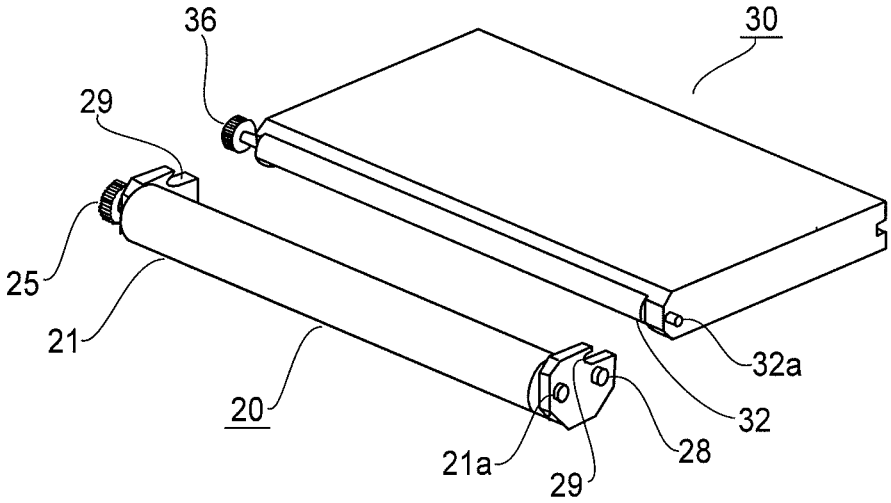
Figure 17:
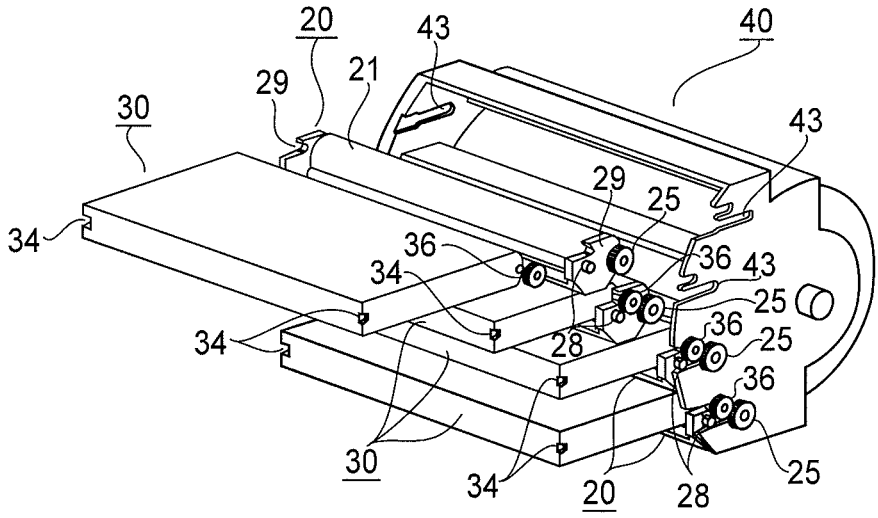
FIGS. 17(*a*) and 17(*b*) are perspective and side views, respectively, of the combination of the process cartridges and intermediary transfer unit of the image forming apparatus which is in the abovementioned miscellaneous embodiment of the present invention and employs the process cartridges, the development unit and photosensitive drum unit of which are independently replaceable from each other. They are for describing the cartridge positioning mechanism of the apparatus and depict the combination when a couple of the process cartridges are not in engagement with the intermediary transfer unit.
Figure 17:
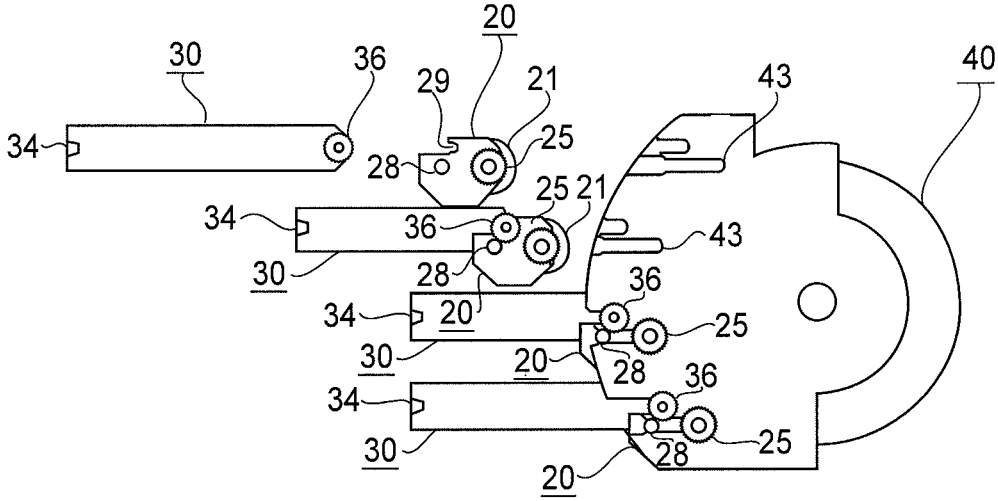

Further, in the preceding embodiments, the development unit 30 belonged to the process cartridge (PY, PM, PC, and PK), the development unit 30 and photosensitive drum unit 20 of which were not separable from each other. However, the present invention is also compatible with a process cartridge, the development unit and photosensitive drum unit of which are independently replaceable from each other. That is, the application of the present invention to an image forming apparatus which employs such process cartridges also provide the same effects as those described above. For example, referring to FIG. 15, the present invention is compatible with a process cartridge structured so that as the lengthwise end portions of the rotational axle 32*a* of the development roller 32 of the development unit 30 engage into the pair of development unit positioning grooves 29 of the photosensitive drum unit 20, the development unit 30 and photosensitive drum unit 20 become accurately positioned to each other. Further, referring to FIGS. 16, 17(*a*) and 17(*b*), the present invention is applicable to such an image forming apparatus design that the photosensitive drum unit 21, with which the development unit 30 engages, is accurately positioned relative to the intermediary transfer unit 40 by the engagement of the rotational axle 21*a* of the photosensitive drum 21 of the photosensitive drum unit 20, and the pair of photosensitive drum rotation preventing portions 28 of the photosensitive drum unit 20, into the pair of photosensitive drum unit positioning grooves 43 of the intermediary transfer unit 40.

Further, the application of the present invention is not limited to the image forming apparatus design which places the means for positioning the photosensitive drum unit 20, on the intermediary transfer unit 40. That is, the present invention is compatible with also such an image forming apparatus design that the means for accurately positioning the photosensitive drum unit 20 is placed on the side walls of the apparatus main assembly 100.

Further, in the preceding embodiments, each of the image forming apparatuses was such an image forming apparatus that employed four process cartridges which are removably mountable in the main assembly of the image forming apparatus. However, the present invention does not require that the process cartridge count is limited to four. That is, the present invention is compatible with any image forming apparatus design of the above described type regardless of the process cartridge count of the design.

Further, each of the exposing apparatuses in the preceding embodiments was a laser scanner unit. However, the present invention does not require that the exposing apparatus is a laser scanner unit. That is, the present invention is also compatible with exposing apparatuses made up of an LED array, or the like.

Further, each of the process cartridges in the preceding embodiments was such a process cartridge that integrally comprises a photosensitive drum, and a combination of processing means, more specifically, charging means, a developing means, and a cleaning means. However, the preceding embodiments are not intended to limit the present invention in scope. That is, the present invention is also compatible with a process cartridge that integrally comprises a photosensitive drum and only one processing means among a charging means, a developing, and a cleaning means.

Also in the preceding embodiments, each image forming apparatus was a printer. However, these embodiments are not intended to limit the present invention in scope. That is, the present invention is compatible with an image forming apparatus other than a printer. For example, the present invention is compatible with a copying machine, a facsimile machine, etc., and a multifunction apparatus capable of performing two or more functions of the preceding image forming apparatuses. Further, each image forming apparatus was such an image forming apparatus that uses an intermediary transfer member; sequentially transfers in layers multiple monochromatic toner image, different in color, onto the intermediary transfer member; and transfers all at once the multiple toner images onto recording medium. However, these embodiments are not intended to limit the present invention in scope. That is, the present invention is also compatible with such an image forming apparatus that uses a recording medium bearing member; and sequentially transfers in layer multiple monochromatic toner images, different in color, directly onto the recording medium on the recording medium bearing member. The effects of the application of the present invention to these image forming, apparatuses (other than those in preceding embodiments) are the same as those described above.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 281858/2009 and 258559/2010 filed Dec. 11, 2009 and Nov. 19, 2010 which are hereby incorporated by reference.

What is claimed is:

1. An electrophotographic image forming apparatus for forming an image on a recording material, said electrophotographic image forming apparatus comprising:

a main assembly;

a cartridge detachably mountable to said main assembly, said cartridge including a first unit having an electrophotographic photosensitive member, and a second unit pivotably connected with said first unit and having a developing roller for supplying developer to said electrophotographic photosensitive member;

an opening, provided in said main assembly, for permitting mounting and demounting of said cartridge;

an openable member, provided in said main assembly, for openably closing said opening;

an exposure device, provided on said openable member, for exposing said electrophotographic photosensitive member; and a first positioning portion, provided in said main assembly, for positioning said first unit, wherein said exposure device is provided with a second positioning portion for positioning said second unit so that said second unit does not rotate relative to said first unit, and said second positioning portion being directly engaged with said second unit by closing said openable member.

2. An apparatus according to claim 1, wherein two of said second positioning portion are provided, said second positioning portions being provided at each of lateral sides with respect to the mounting and demounting direction of said cartridge, and wherein one of said second positioning portions is engaged with said cartridge with a gap therebetween.

3. An apparatus according to claim 1, wherein said second positioning portion is provided in a central portion with respect to the mounting and demounting direction of said cartridge.

4. An apparatus according to claim 1, wherein said second unit is provided with a cartridge positioning portion engageable with said second positioning portion.

5. An apparatus according to claim 1, wherein, in said second positioning portion, an urging force is applied in the same direction as the direction of said first positioning portion.

6. An apparatus according to claim 5, wherein said second positioning portion is provided with an electrical contact supplying electric power to process means provided in said cartridge.

7. An apparatus according to claim 5, wherein said second positioning portion is engaged with a blocking member for closing an exposed portion of said exposure device, and said blocking member opens said exposed portion when urging said cartridge, and closes said exposed portion when not urging said cartridge.

8. An apparatus according to claim 1, wherein said main assembly includes a main assembly positioning portion for positioning said exposure device relative to said main assembly by engagement with said exposure device, and wherein said exposure device is provided with a third positioning portion that (i) is supported by said openable member for movement within a predetermined range and (ii) is engageable with said main assembly positioning portion to be positioned relative to said main assembly by closing said openable member.

9. An electrophotographic image forming apparatus for forming an image on a recording material, said elegrophotographic image forming apparatus comprising:

a main assembly;

a cartridge including an electrophotographic photosensitive member, said cartridge being detachably mountable relative to said main assembly;

an opening provided in said main assembly for permitting mounting and demounting of said cartridge;

an openable member, provided in said main assembly, for openably closing said opening;

an exposure device, provided on said openable member, for exposing said electrophotographic photosensitive member;

a first positioning portion, provided in said main assembly, for positioning a downstream side of said cartridge with respect to a mounting direction of said cartridge to said main assembly; and a second positioning portion, provided in said exposure device, for positioning an upstream side of said cartridge with respect to the mounting direction, wherein said second positioning portion is directly engaged with the upstream side of said cartridge by closing said openable member.

* * * * *